United States Patent [19]

Ilfrey et al.

[11] Patent Number: 4,858,691

[45] Date of Patent: Aug. 22, 1989

[54] GRAVEL PACKING APPARATUS AND METHOD

[75] Inventors: William T. Ilfrey, Spring; Edward C. Spatz, Houston; Elmer R. Peterson, The Woodlands, all of Tex.; William Moran, Broussard, La.

[73] Assignee: Baker Hughes Incorporated, Houston, Tex.

[21] Appl. No.: 206,209

[22] Filed: Jun. 13, 1988

[51] Int. Cl.[4] ..... E21B 43/04; E21B 43/08

[52] U.S. Cl. ..... 166/278; 166/51; 166/230; 166/236

[58] Field of Search ..... 166/51, 278, 230, 227, 166/236, 205, 157, 158

[56] References Cited

U.S. PATENT DOCUMENTS

| | | | |
|---|---|---|---|
| 273,166 | 2/1883 | Schreiber | 166/230 X |
| 997,191 | 7/1911 | Hogarth | 166/230 X |
| 1,218,848 | 3/1917 | Foster | 166/236 X |
| 2,190,989 | 2/1940 | Johnston | 166/250 |
| 2,371,385 | 3/1945 | Eckel | 166/296 X |
| 2,523,091 | 9/1950 | Bruce | 166/228 X |
| 2,525,897 | 10/1950 | Greene | 166/228 X |
| 2,530,223 | 11/1950 | Breaux | 166/228 |
| 2,877,852 | 3/1959 | Bashara | 166/230 |
| 2,978,033 | 4/1961 | Pitcher et al. | 166/205 X |
| 2,981,332 | 4/1961 | Miller et al. | 166/276 |
| 2,985,241 | 5/1961 | Hanslip | 166/230 |
| 3,261,401 | 7/1966 | Karr | 166/51 X |
| 3,277,962 | 10/1966 | Flickinger et al. | 166/278 |
| 3,455,387 | 7/1969 | Peters | 166/278 |
| 3,987,854 | 10/1976 | Callihan et al. | 166/278 |
| 4,018,283 | 4/1977 | Watkins | 166/278 |
| 4,124,074 | 11/1978 | Allen et al. | 166/278 |
| 4,428,431 | 1/1984 | Landry et al. | 166/278 X |
| 4,434,054 | 2/1984 | Livesay et al. | 210/484 |
| 4,494,603 | 1/1985 | Harguindey | 166/231 |
| 4,526,230 | 7/1985 | Kojicic | 166/228 |
| 4,541,484 | 9/1985 | Salerni et al. | 166/278 |
| 4,553,595 | 11/1985 | Huang et al. | 166/278 |
| 4,583,594 | 4/1986 | Kojicic | 166/236 |
| 4,649,996 | 3/1987 | Kojicic et al. | 166/228 |
| 4,754,807 | 7/1988 | Lange | 166/51 X |

*Primary Examiner*—Stephen J. Novosad

*Attorney, Agent, or Firm*—Hubbard, Thurman, Turner & Tucker

[57] ABSTRACT

A method and apparatus are provided for use on a subterranean well gravel packing conduit. The apparatus incorporates a cylindrically shaped inner tubular member having an interior wall and an exterior wall. A fluid flow passageway is defined within the interior wall of the tubular member and fluid flow passage means extends from the interior of the tubular member through the exterior wall and communicates with the fluid flow passageway. In a preferred embodiment, an outer fluid-porous means, or particulate restricting means is carried around the exterior wall of the tubular member having its interior facing the tubular member. Wire mesh means are disposed between the exterior wall of the tubular member and the interior of the particulate-restricting means, and passing across the fluid flow passage means, with fluid flow openings therethrough, to enable fluid passing through the particulate restricting means and the wire mesh means to be filtered to prevent solids of a predeterminable size from passing into the fluid flow passage means, to the top of the well. The device may be utilized in a number of well completion hook-ups, such as in non-vertical completion apparatuses and methods.

31 Claims, 12 Drawing Sheets

GRAVEL PACKING APPARATUS AND METHOD

CROSS-REFERENCE TO RELATED APPLICATION

This application is, in part, related in subject matter to co-pending application Serial No. 172,025, filed March 23, 1988, and entitled "Method and Apparatus for Completing a Non-Vertical Portion of a Subterranean Well Bore", and assigned to the assignee of this application.

BACKGROUND OF THE INVENTION

1. FIELD OF THE INVENTION

The invention relates to a method and apparatus for providing a "pre-packed" gravel packing screen for use in subterranean oil and gas wells.

2. SUMMARY OF THE PRIOR ART

When oil and gas wells are drilled through formations which generally are of an unconsolidated nature, the produced fluids can be expected to contain particulate, solid matter, generally referred to as "sand". It is undesirable to produce such particulate matter with the production fluids because of abrasion of production tubing, valves and other equipment used to produce the well and carry such fluids from the well, through the sales line, and the like. It is therefore necessary in such instances to avoid production of such sand and other particulate matter with the fluids.

In the past, those skilled in the art have reduced the production of sand by "gravel packing" the well during the completion operation. Such gravel packing has included providing on the production conduit or tubular work string a device including a slotted or ported cylindrically shaped member which prevents the passage therethrough and into the interior of the conduit of solid particles exceeding a predetermined size. Such devices are incorporated into equipment and methods wherein gravel is introduced into the annular area between the production conduit or work string and the casing of the well (or, in the event of non-cased wells, the well bore wall), with the gravel being deposited longitudinally exteriorly of the slotted or ported cylindrical member.

Gravel packing of such wells has also been effected by means of incorporation onto the production or work string of a "pre-pack" apparatus, wherein gravel, glass beads, or other solid particulate is disposed in between an outer member, such as stainless steel wire wrapped screen, and an inner ported member, such that the device may be carried into the well and positioned adjacent the production zone to thereby prevent the particulate sand produced with the production fluids from entering the interior of the conduit and being produced to the top of the well with the production fluids. Such "pre-packs" may be used alone or in conjunction with apparatus and method wherein the well bore is also gravel packed.

The present invention provides a "pre-packed" apparatus and method for gravel packing a subterranean oil or gas well wherein a wire mesh having selective sized openings between the mesh members is provided in the apparatus, instead of incorporation of the solid particulate materials used in the prior art.

The prior art contains a number of references of gravel packing methods and apparatuses incorporating slotted, ported or wire-wrapped screen devices which have disposed therein particulate matter, such as glass beads, gravel, and the like, including the following U.S. Pat. Nos.:

| U.S. Pat. No. | Title |
|---|---|
| 1,218,848 | STRAINER FOR PUMPS |
| 2,190,989 | METHOD OF PREPARING AN OIL WELL FOR PRODUCTION |
| 2,371,385 | GRAVEL PACKED LINER AND PERFORATION ASSEMBLY |
| 2,523,091 | OIL-WATER SEPARATOR FOR WELLS |
| 2,525,897 | WELL PIPE FILTER |
| 2,530,223 | OIL WELL FILTER |
| 2,877,852 | WELL FILTERS |
| 2,978,033 | DRILLABLE PREPACKED SAND CONTROL LINER |
| 2,981,332 | WELL SCREENING METHOD AND DEVICE THEREFOR |
| 3,261,401 | WATER PRODUCTION |
| 3,455,387 | WELL COMPLETION TECHNIQUE AND APPARATUS FOR USE THEREWITH |
| 4,494,603 | WIRE MESH WELL SCREEN WITH WELDED WIRE SUPPORT |
| 4,583,594 | DOUBLE WALLED SCREEN-FILTER WITH PERFORATED JOINTS |
| 4,526,230 | DOUBLE WALLED SCREEN-FILTER WITH PERFORATED JOINTS |
| 4,649,996 | DOUBLE WALLED SCREEN-FILTER WITH PERFORATED JOINTS |

Representative of the prior art is U.S. Pat. No. 4,494,603, which includes an outer stainless steel wire wrapped screen, such as shown in FIGS. 1 and 3 thereof, disposed around a series of circumferentially extending porous rod elements 12. Such screen would not be desirable for use in subterranean oil and gas wells, contemplated herein, and particularly in conjunction with method and apparatus for completing non-vertical wells, also as contemplated herein, with such device including wire mesh disposed between the support rods and the helically wrapped wires. There are many reasons why such construction is inappropriate for use in completion techniques for subterranean oil and gas wells, although such device may have some application in shallow, water wells. For example, such device, incorporating the rods, cannot provide the tensile load through the rods to carry sections of production and work string therebelow, as is often customary in completion techniques for subterranean oil and gas wells completed at extensive depths.

For many years the desirability of utilizing a subterranean well bore having a non-vertical or horizontal portion traversing a production formation has been known and appreciated in the prior art. Laterally directed bores are drilled radially, usually horizontally, from the primary vertical well bore, in order to increase contact with the production formation. Most production formations have a substantial horizontal extent and, when conventional vertical well bores are employed to tap such production formations, a large number of vertical bores must be employed. With the drilling of a well bore having a non-vertical or horizontal portion traversing the production formation, a much greater area of the production formation may be traversed by the well bore and the total field drilling costs may be substantially decreased. Additionally, after a particular horizontal well bore has produced all of the economically available hydrocarbons, the same vertical well bore may be redrilled to establish another horizontal portion extending in another direction and thus prolong the utility of the vertical portion of the well and increase the productivity of the well to include the total production formation.

One of the completion techniques that has not been worked out, particularly for wells having medium radius turns on the order of about 10°-90° per 100 feet of well length, is the design, insertion and operation of gravel packing or other Sand Control equipment. Wells incorporating such medium radius curvature between the horizontal and vertical portions of the well bore have been completed only by utilizing the open hole technique or inserting a slotted liner.

U.S. Pat. No. 4,553,595 to HUANG et al proposed that gravel packing be accomplished in two distinct steps. In the first step, the horizontal segment of the well bore is provided with a foundation layer of unconsolidated gravel supplied through a flexible tube, hence with no control of the depth of the layer. A perforated liner is then introduced into the well resting on the initial layer of gravel. Those skilled in the art will recognize that "gravel" used in gravel packing of a well, as well as the material referred to herein in "pre-packed" screens, can be coarse sand, glass beads, solid polymeric-like substances, and the like, and can generally be defined as solid particulate matter which blocks the entry into the production tubing of produced sand and other solids but permits the flow into the production tubing of the production fluids.

The second phase of the gravel pack is achieved by introducing a gravel slurry through flexible hoses attached to the exterior of the slotted liner, such slurry being deposited on the foundation bed and hopefully building up around the liner. The disadvantages and shortcomings of this approach will be readily apparent to those skilled in the art.

Gravel packing of conventional wells is efficiently accomplished by gravel packing apparatus of the type disclosed in U.S. Pat. No. 3,987,854 to CALLIHAN et al. The apparatus employed in this patent incorporates a hydraulically operated packer, which is connected to the top of a screen section. The packer is provided with conventional left hand threads which in turn are connected to a left hand threaded nut carried on the top end of a cross-over tool which is secured to the bottom end of a tubing string.

This conventional type of gravel packing apparatus is unsuited for the gravel packing of horizontal well bores having a significant longitudinal extent on the order of 1000–2000 feet, and more. In the first place, to insert this apparatus through the radius portion of the well bore, it may be necessary that the apparatus be rotated, which rotation will of course be in a clockwise direction, as is conventional. The resistance to passage of the apparatus through the short radius curved sections of the well bore is sufficiently high as to allow clockwise rotation of the left hand threaded nut relative to the packer. Thus, the packer and nut would become disengaged upon the application of excessive torques required to rotationally insert the gravel packing tool into the well.

An even more important deficiency lies in the fact that the introduction of the gravel packing fluid is conventionally accomplished by flowing the gravel containing fluid externally through the annulus defined between the screens and the well bore. With a well bore having a non-vertical, and particularly a horizontal extent of 1000 to about 2000 feet, there is no assurance that the gravel contained in the gravel packing fluid will not build up around centralizers and bridge across the annulus long before it reaches the end of the 1000–2000 foot length of screen traversing the horizontal production formation.

Any attempt to utilize conventional centralizers to center the multitude of screens relative to the horizontal well bore also creates additional problems. All conventional centralizers are subject to destruction by rotation of the tubing string upon which they are carried, particularly when compressed betweeen the wall of the well bore or casing and the tool string. Thus, the employment of conventional stabilizers, which are essential for locating the screens axially aligned within the well bore, is effectively prohibited by the required rotation of the screens during the process of inserting the tool string through any radius curved portion of the well bore. These are only a few of the problems that must be solved if the industry goal of achieving efficient production from well bores having non-vertical or horizontal portions of substantial longitudinal extent traversing production formations, is to be accomplished.

SUMMARY OF THE INVENTION

The present invention is directed to an apparatus for use in a subterranean well gravel packing conduit. The apparatus comprises a cylindrically shaped inner tubular member having an interior wall and an exterior wall. A fluid flow passageway as defined within the interior wall of the tubular member and a fluid flow passage extends from the interior of the tubular member through the exterior wall and in communication with the fluid flow passageway. In a preferred embodiment, an outer fluid-porous or particulate-restricting means is carried around the exterior wall of the tubular member and has its interior facing the tubular member. In such embodiment, wire mesh means are disposed between the exterior wall of the tubular member and the interior of the particulate-restricting means and pass across the fluid flow passage means. At least one of the inner tubular member and the particulate restricting means is secured at at least one of its ends to the subterranean well gravel packing conduit. Fluid passing through the particulate restricting means and the wire mesh means is filtered to prevent solids of a pre-determinable size from passing into the fluid flow passage means and into the fluid flow passageway.

The invention also contemplates the assemblage of a tool string comprising a plurality of such gravel packing apparatuses between each of which a stabilizer housing is threadably connected. Additional stabilizer housings may be connected to each end of the tool string. When it is necessary to pass a tool string through a well bore having a relatively short radius of curvature, the shorter the length of the individual components and the greater the number of threaded joints in the tool string, the easier it will be to effect the transition of the tool string through the curved portion of the well bore.

Each tubular stabilizer housing incorporates a plurality of peripherally spaced stabilizer elements which are normally held during run-in in a radially retracted position so that rotation of the tool string has no effect on the stabilizer elements. When the tool string is run into the non-vertical or horizontal portion of the well bore, fluid pressure is provided to effect the radially outward displacement of the stabilizer elements, thus insuring that each screen element of the tool string is positioned properly in the non-vertical well bore.

By use of and reference to the phrase "well bore" herein, we intend to include both cased and uncased wells. When uncased wells are completed, the bore hole wall defines the maximum hole diameter at a given location. When cased wells are completed the "wall" of the well will be the internal diameter of the casing conduit.

Such operation of the stabilizer elements may be accomplished by providing a shearably secured piston having opposite end faces of unequal area exposed to well bore pressure and, in such position, effects the securement of the stabilizer elements in their retracted positions. After insertion of the tool string in the well bore, the fluid pressure in the well bore is allowed to act on a heretofore unexposed area of the pistons and thus shears the shearable securement of the pistons and effects the shifting of the pistons to move the stabilizer elements to their radially expanded positions of engagement with the well bore wall or casing.

If the length of the non-vertical or horizontal well bore portion is relatively short, say on the order of 100–200 feet, then it is possible to utilize a gravel packing apparatus constructed generally in accordance with the disclosure of the aforementioned U.S. Pat. No. #3,987,854. However, this construction has to be substantially modified, in accordance with this invention, to prevent the rotation of the left handed nut, which is rotationally secured to the work string, relative to the pressure settable packer so as to prevent premature disengagement of the work string from the packer as the whole tool string is rotated in order to force it through the radius curvature portions of the well bore.

In accordance with this invention, an anti-rotation tool is provided for connection between the work string, the packer, and the cross-over tool. Such tool prevents any rotation of the work string and cross-over tool relative to the packer during the insertion of the tool string into the well bore. Such anti-rotation tool comprises an inner body sleeve which is threadable connected by a connecting sub to the bottom of the work string. A collet is mounted on the body sleeve for non-rotational, axial movements and is spring biased to a lower position. Segment threads are mounted on depending arms of the collet and held in engagement with the internal left hand threads of a conventional packer by a piston sleeve which is shearably secured to the inner body sleeve.

Relative rotation between the work string and packer is prevented by an anti-rotation outer sleeve axially slidably and sealably mounted on the connecting sub but secured against rotation relative to the connecting sub by a key. The lower end of the anti-rotation sleeve defines a plurality of peripherally spaced, square lugs which engage square notches formed in the packer above the left hand threads, thus securing the packer to the work string for co-rotation. Shear screws prevent upward disengaging movement of the anti-rotation sleeve. After the tool string has been run through the short radius, curved portions of the well bore by combined axial and right hand rotation movement of the work string, the pumping of a ball onto an upwardly facing, expandable ball seat provided in the bore of the packer will permit the build up of fluid pressure in the work string to set the packer.

To deactivate the anti-rotation tool, annulus pressure in the well may be increased above tubing pressure, thus producing an upward force on the piston sleeve to shear its securement and move the piston sleeve axially to release the collet thread segments from the packer left hand threads, thus permitting upward movement of the work string relative to the packer. Such upward movement releases the anti-rotation sleeve from engagement with the packer threads, hence releases the work string and anti-rotation tool from the packer.

If for any reason, the piston sleeve fails to release the threaded collet segments from the packer left hand threads, a backup release mechanism is provided. The upper portion of the anti-rotation sleeve cooperates with the connecting sub to define a fluid pressure chamber communicating with tubing pressure. An increase in tubing pressure level above that required to set the packer will urge the anti-rotation sleeve upwardly, shear the shear screws, and release the lugs of the anti-rotation sleeve from the packer threads. Rotation of the work string will now cause the collet thread segments to unthread from the packer left hand threads to completely release the anti-rotation tool from the packer. This permits the cross-over tool to be axially shifted by the tubular string to an operative position relative to the packer, wherein gravel carrying fluid passes downwardly through a first axial passage in the crossover tool to flow into the annulus surrounding the gravel packing apparatus. The liquid portions of the gravel carrying fluid moves upwardly through a second axial passage in the cross-over tool to flow into the well bore annulus above the set packer.

For gravel packing non-vertical or horizontal bore portions having an extended length on the order of 1000–2000 feet, the employment of any known gravel packing tool, such as that described in the aforesaid U.S. Pat. No. 3,987,854 may not produce reliable results. In accordance with this invention, the gravel packing of such extended lengths of non-vertical or horizontal well bore is accomplished by inserting a stabilizer housing between successive gravel packing apparatuses. A tubular sleeve valve element having at least one normally open radial port is then connected to the uppermost gravel packing apparatus. Additionally, an isolation packer is connected between the sleeve valve element and the lower gravel packing apparatus of the next pair of gravel packing apparatuses. Thus, the gravel packing tool string comprises a plurality of sections, with each section comprising from the bottom up, a lower gravel packing apparatus of relatively limited axial extent, a stabilizer housing of the type previously described, having normally retracted stabilizer elements during run-in, an upper gravel packing element of relatively limited axial extent, a sleeve valve housing, and an isolation packer. The isolation packers are preferably of the type that is set through the application of a fluid pressure applied through the tubular string by which the tool string is run into the well. All of these gravel packing sections are threadably interconnected, and the uppermost isolation packer is connected to the bottom end of a tubular string, which may comprise the production string.

A cross-over tool embodying this invention is then lowered through the production string by a tubular work string and inserted through the curved portion of the well bore by rotational and axial movement, and thence into the non-vertical or horizontal bore portion to a position immediately adjacent the lowermost isolation packer. The crossover tool is provided with a pair of axially spaced, external seals which respectively cooperate with axially spaced seal bores provided in the packer or the sleeve valve housing at locations respectively above and below the radial ports in such sleeve valve housing.

The cross-over tool is provided with an axially extending bore which is open at its top to communicate with the bore of the work string, and at bottom end is contoured to communicate with the radial ports which are disposed intermediate the axially spaced, external seals. Thus, gravel carrying fluid introduced through the tubular work string will pass through the cross-over tool, through the port in the sleeve valve housing and thence downwardly into the annulus defined between the well bore or casing and the external surface of the lowermost gravel packing apparatus. The gravel is, of course, prevented from passing through the gravel packing apparatus by virtue of being a greater size than the openings therein, and the fluid which carried the gravel passes through the gravel packing apparatus and then moves upwardly into a second axial passage provided in the cross-over tool which has a radial opening at its upper end above the packer and communicating with the annulus surrounding the tubular work string. Since this annulus is in communication with the well bore annulus, the liquid component of the gravel carrying fluid can readily move to the surface of the well.

Upon conclusion of the gravel packing of the lowermost pair of gravel packing apparatus, the well operator will note an increase in fluid pressure due to the blocking of the openings through which the gravel carrying fluid must pass. Upon receipt of such signal, the well operator moves the work string carrying the cross-over tool upwardly to position the cross-over tool adjacent the next upwardly adjacent sleeve valve housing. A collet provided on the cross-over tool detachably engages the valve sleeve provided in the sleeve valve housing and moves it upwardly to close the lowermost radial ports. Gravel packing of the next two gravel packing apparatuses can thus progress in the same manner as described for the lowermost section.

Successive upward movements of the work string will thus permit each gravel packing apparatus to be gravel packed and, when all gravel packing apparatuses are packed, the work string and the appended cross-over tool may be removed from the well and the well is ready to be placed into production, with all gravel packing apparatuses being reliably gravel packed around their exterior.

The present invention also contemplates utilization of a gravel packing apparatus which can effect the gravel packing of a series of positioned zones within a horizontal section of a subterranean well with the tubing carrying the gravel packing apparatus requiring only one trip to effect the entire gravel packing, as opposed to the series of trips in the gravel packing device as particularized, above. Typical of such apparatuses is that as shown in U.S. Pat. No. 4,401,158, entitled "One Trip Multi-Zone Gravel Packing Apparatus", issued to the predecessor of the current assignee, on August 30, 1983. Such an apparatus effects the sequential gravel packing of a plurality of zones and comprises primary sealing means, which may be a hydraulically set packer which is adapted for setting in the casing at a position immediate the production zones. A plurality of gravel packing apparatuses of the present invention, together with valve means which are selectively movable between open and closed positions are provided, with the valve means being equal in number to the production zones and being carriable in the well with the primary sealing means and extending in series relationship thereto. A production zone isolation means, which may be a second packer or packers, are connected between each of the sets and are expansible into sealing engagement with the casing intermediate the adjacent production zones. A control mandrel is provided and is carriable on a conduit in the well with the primary sealing means and is movable within all of the sets. The control mandrel includes a single cross-over means for diverting gravel carrying fluid from the interior of the mandrel to the exterior thereof, similar to the cross-over tool described above in an apparatus which requires more than one trip to effect the gravel packing of a zone. A plurality of vertically spaced sealing means are provided on the control mandrel for successfully isolating each set from the others when the cross-over means on the control mandrel is positioned in proximity to each of the valve means. Means are provided on the control mandrel for opening the valve by longitudinal movement of the control mandrel in one direction and closing the valve means by longitudinal movement of the control mandrel in another direction. Means are provided for supplying gravel carrying fluid to the interior of the control mandrel whereby each excessive production zone may be gravel packed by successfully moving the conduit and the mandrel assembly to cooperate with each of the sets, without retrieving the conduit from within the well during the sequential gravel packing of the well at the horizontal placement position.

DESCRIPTION OF PREFERRED EMBODIMENTS

Figure 1:
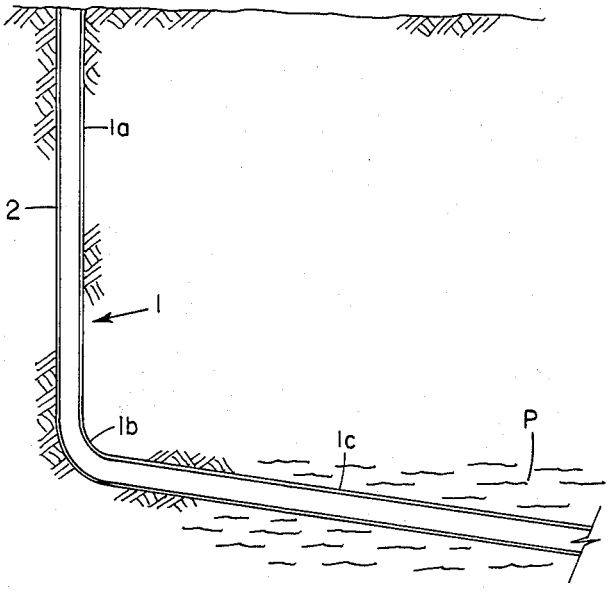
FIG. 1 is a schematic view of a well bore of the type having a non-vertical or horizontal end portion traversing a production formation.

Referring to FIG. 1 there is shown a deviated well bore of the type for which this invention is particularly useful. Such well bore comprises a vertical entry section 1*a* communicating through a relatively short radius curvature portion 1*b* with a non-vertical or horizontal portion 1*c* communicating with a production formation P. In most instances, the production formation P extends for a substantial horizontal extent and the generally linear well bore portion 1*c* traverses a substantial horizontal extent of the production formation, at least up to a distance of 1000 to 2000 feet or more. The radius portion lb of the well bore has a curvature of at least 10° per 100 feet of length and preferably a curvature lying in the range of 10°–30° per 100 feet of length. Obviously, the greater the radius of curvature, the less difficult is the problem of inserting a tool string into the non-vertical production portion 1*c* of the well bore. While not limited thereto, each of the modifications of this invention will be described in connection with a casing 2 having been previously inserted in the well bore and perforated as shown at 2*c*, although this is not necessary, particularly in the curved portions 1*b* and the linear non-vertical or horizontal portions 1*c* traversing the production formation P.

In any event, it is essential that the tool string employed for completing such a well, and in particular a gravel packing tool string, be capable of a combined axial and rotational movement to force the string through the radius curved portion 1*b* of the well bore. It is also essential that any protusions on the tool string, such as the centralizers commonly employed in a generally vertical well, be completely retracted within the body of tee tool string in order to prevent damage to the centralizer elements as they are rotated through the radius curved portion 1*b* of the well bore.

Referring now to FIGS. 2A, 2B, 2C and 2D, the portion of the tool string employed for gravel packing the non-vertical production portion 1*c* of the well bore 1 is illustrated. While this portion has been illustrated on the drawings as lying in a substantially vertical orientation, it is to be understood that the orientation is really non-vertical and generally horizontal, but the vertical orientation has been used in the drawings since those skilled in the art are use to looking at well tool strings with the components thereof vertically oriented.

The gravel packing apparatus illustrated in the modification of FIGS. 2A, 2B, 2C and 2D is run into the non-vertical, or horizontal well bore portion 1*c* by a tubular work or similar string or conduit 3. Tubular work string is threadably connected by threads 3*a* to the top portion of an anti-rotation tool 10 which in turn is threadably connected at its lower end by left hand collet threads 14*c* to the upwardly facing left hand threads 20*a* normally provided on a conventional well isolating means, such as a packer 20. Additionally, the lower end of an inner body element 15 of the anti-rotation tool 10 is threadably connected by threads 15*c* to the top end 41 of a cross-over tool 40 of the type generally shown in the aforementioned U.S. Pat. No. 3,987,854. Packer 20 may comprise any conventional type including an expandable elastomeric sealing element 21 and a plurality of peripherally spaced slip elements 22. Packer element 20 is preferably of the fluid pressure operated type wherein the seal elements 21 and slip elements 22 are expanded into engagement with the bore 2*a* of the casing 2 by a pre-determined increase in fluid pressure supplied to the packer through the work string 3. Other type packers may, however, be utilized, taking into account the difficulty of achieving axial and rotational movements due to the frictional constraint imposed on the tool string by its passage through the curved well bore section 1*b*.

Packer 20 additionally has an axially depending tubular body portion 23 which is provided at its upper end with an upper seal bore 23*d*, a plurality of axially spaced radial ports 23*a* in its lower end portion, and a lower seal bore 23*b*. Tubular body portion 23 is threadably connected by threads 23*d* at its lower end to the uppermost one of a plurality of serially connected, gravel packing apparatus 500 which are interconnected by stabilizer housings 60 and extend for a substantial length along the non-vertical axis of the well bore portion 1*c*. In the case of a horizontal well bore portion 1*c*, an extent of 100 to 200 feet would be a practical length for the serially connected tubular screen elements 50.

While only three of such gravel packing apparatuses 500 are shown in the drawings, due to space constraints, the gravel packing apparatuses 500 preferably limited in length to improve the flexibility of the tool string to pass through the radius curved portion 1*b* of well bore 1. Thus, anywhere from 10 to 20 or more of such serially connected gravel packing apparatuses 500 would be employed, with a stabilizer housing 60 mounted intermediate each pair of gravel packing apparatus.

Figure 2A:
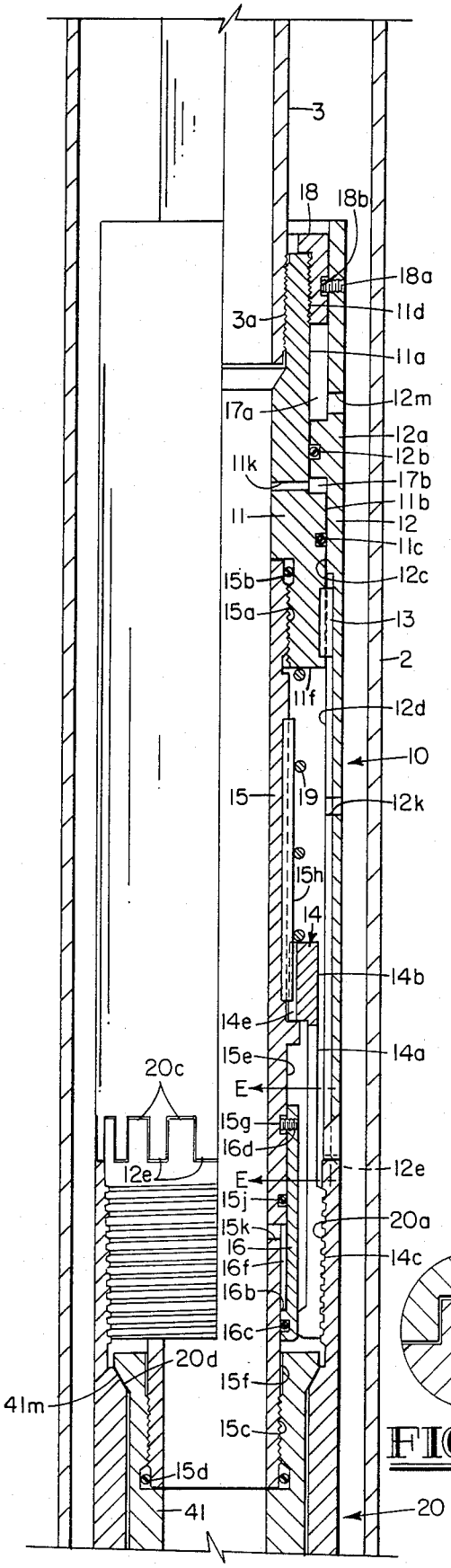
FIGS. 2A, 2B, 2C and 2D collectively constitute schematic vertical quarter sectional views of one embodiment of a gravel packing tool embodying this invention, with the elements of the tool shown in their run-in positions within the portion of the well bore traversing a production formation.
Figure 2E:
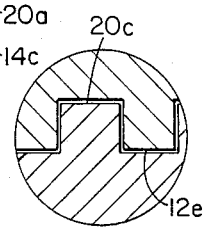
FIG. 2E is a partial sectional view taken on the plane EE of FIG. 2A.
Figure 2B:
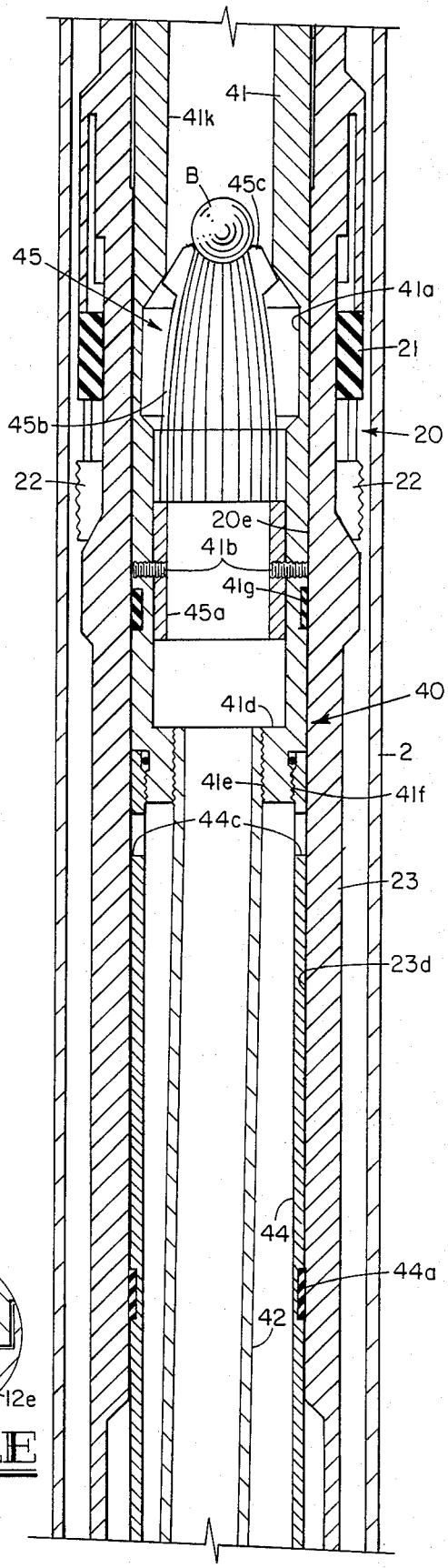
Figure 2G:
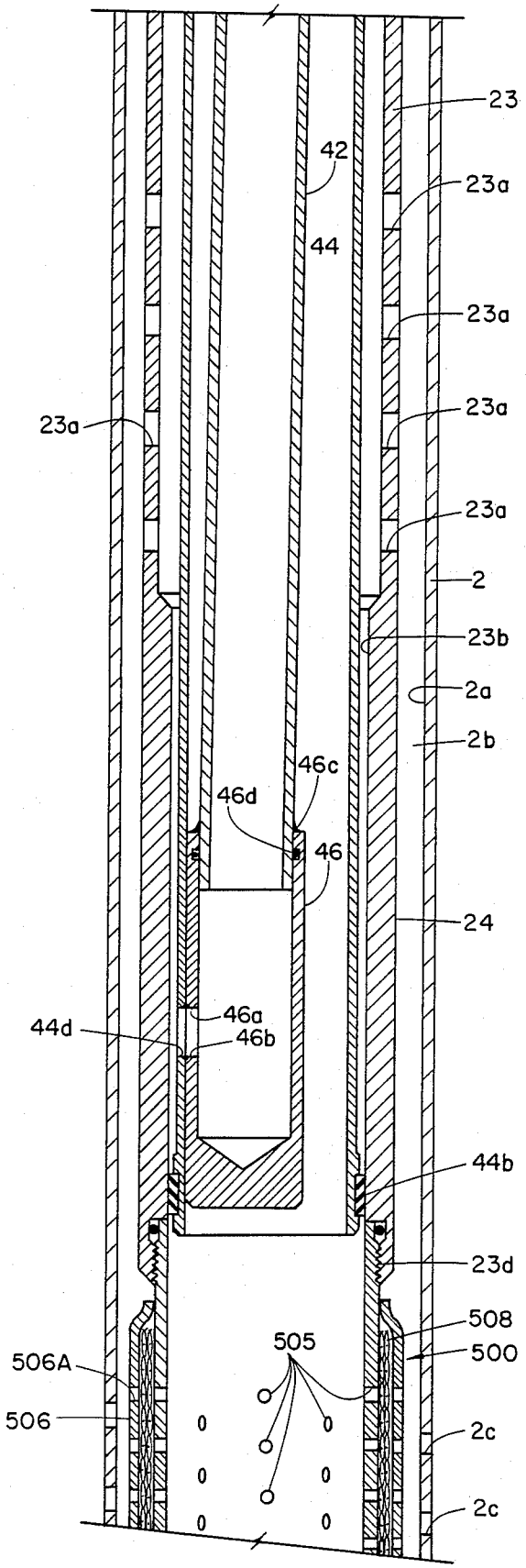
Figure 2D:
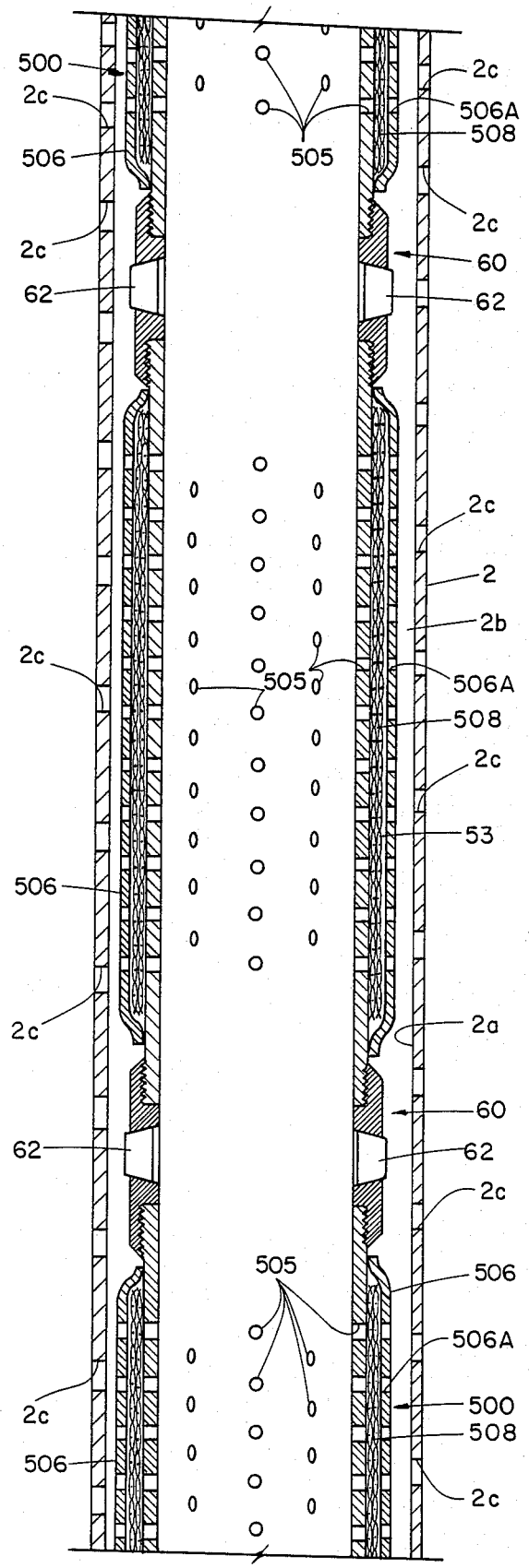

Referring now to FIGS. 2C and 2D, the subterranean well gravel packing apparatus 500 of the present invention has its inner tubular member 501 secured by means of threads 23*d* to subterranean well gravel packing conduit member 24 thereabove. Additionally, the inner tubular member 501 is threadably secured at its lower end to a member 60. As shown in FIG. 2D, other longitudinally disposed apparatuses 500 may be placed selectively along the length of the production or work string conduit.

Figure 9:
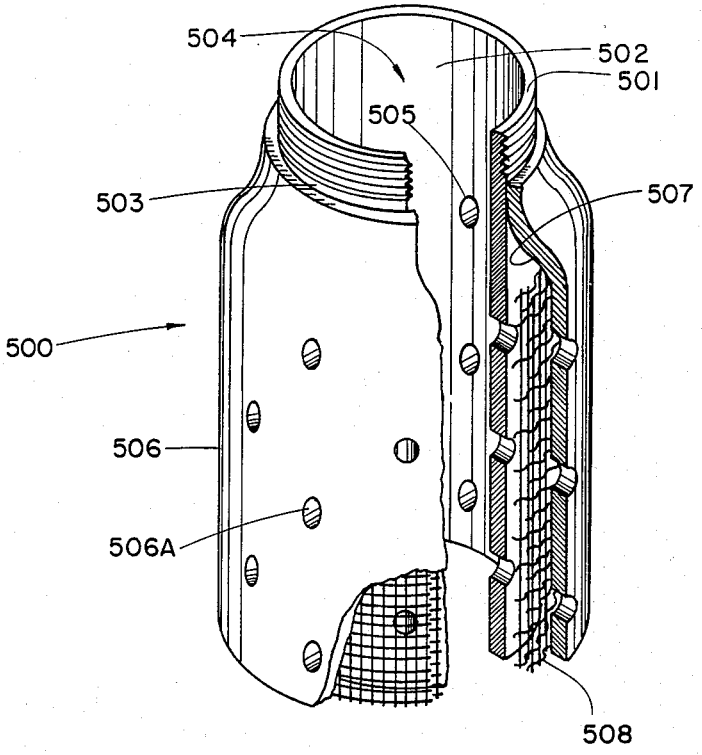
FIG. 9 is a cross-sectional view of the gravel packing apparatus, unsecured to the well conduit.
Figure 10:
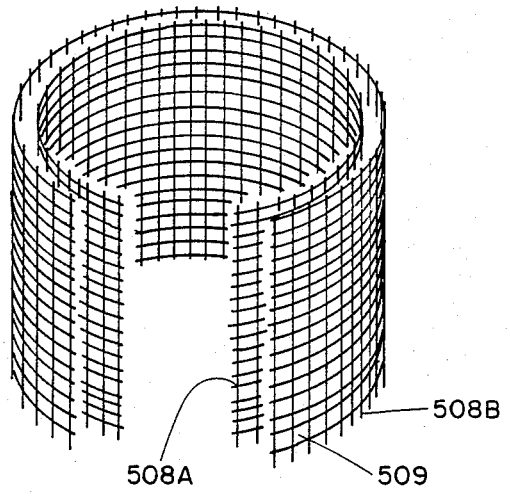
FIG. 10 is a view of the wire mesh means showing, in general, inner and outer wrapping.

With particular reference to FIGS. 9 and 10, the inner tubular member 501 is cylindrically shaped and has an interior wall 502 in communication with the fluid flow passageway 504 through the apparatus 500 and extending through the production or work string conduit to the top of the well. The member 501 also has an exterior wall 503 and fluid flow passage means, or ports, 505 disposed through the interior wall 502 and the exterior wall 503. An outer means, or a fluid porous particulate restricting means 506 is provided in the form of a second cylindrical member having ports 506*a* disposed selectively therethrough. The outer means, or fluid porous particulate restricting means may be a cylinder, as shown, with ports disposed therethrough, or may be provided in the form of stainless steel wire wrapped screen, well known to those skilled in the art, a series of longitudinally or radially spaced ribs, or the like. In any event, the outer or fluid porous particulate restricting means will have its interior 507 facing the exterior wall 503 of the inner tubular member 501. In between the inner tubular member 501 and the particulate restricting means 506 is placed the wire mesh means 508 having selective fluid flow openings 509 therethrough.

As shown in FIG. 10, such wire mesh means may have an inner wrapping 508*a* and an outer wrapping 508*b*, with the wrappings 508*a* and 508*b* being woven between one another, for additional strength purposes. The wire mesh means 508 may be provided in any desired mesh openings between the wire members, but preferably will be between a mesh size of about 40 and about 250.

As utilized in this invention, the wire mesh means may be any one of a number of embodiments. The wire mesh means may be made of plain steel wire or of an alloy or non-ferrous wire such as steel, stainless steel, copper, 70/30 high brass, 90/10 commercial bronze, phosphor, monel, nickel, 5056 aluminum, or combinations thereof. The wire mesh may also be made of any one of a number of special alloys including pure iron, high brass, phosphor bronze, pure nickel, and the like. It may be provided in a coated or uncoated form. In some instances, it may be desirable to coat the wire mesh wires with chemical compounds, such as corrosion inhibitors or other chemical protective compositions.

The wire mesh means 508 may be provided in the form of any one of a number of weaves or crimps. Such weaves include a plain weave, such as that generally shown in FIG. 10, a twilled weave, a plain dutch weave, or a twilled dutch weave. The wire mesh may also be provided in a form of a crimped weave, such as a double crimp, intermediate crimp, lock crimp, or smoothed top crimp.

While the device 500 as illustrated in FIG. 9 is shown with the wire mesh means 508 placed between the inner tubular member 501 and an outer tubular member, or fluid porous particulate restricting means 506, the device 500 may also be provided in an embodiment in which the member 506 is not utilized, and the wire mesh means 508 is secured, such as by chemical bonding, spot welding, or the like, around the exterior of the inner tubular member 501 such that the wire mesh means is placed across each of the ports 505. Alternatively, the wire mesh means may be provided in the form of inner locking loop members, such as that illustrated in FIG. 3A of Reissue Patent No. 31,978 entitled "WELL TOOL HAVING KNITTED WIRE MESH SEAL MEANS AND METHOD OF USE THEREOF", and assigned to Baker Oil Tools, Inc.

As shown in FIG. 10, the wire mesh means 508 may have inner and outer wrappings 508*a* and 508*b*, respectively, which may, or may not, be provided in the same mesh, weave or crimp. For example, the inner wire mesh means 508*a* may be of a mesh where the diameter of the opening 509 is smaller than that through the wire mesh means 508*b*.

Figure 5C:
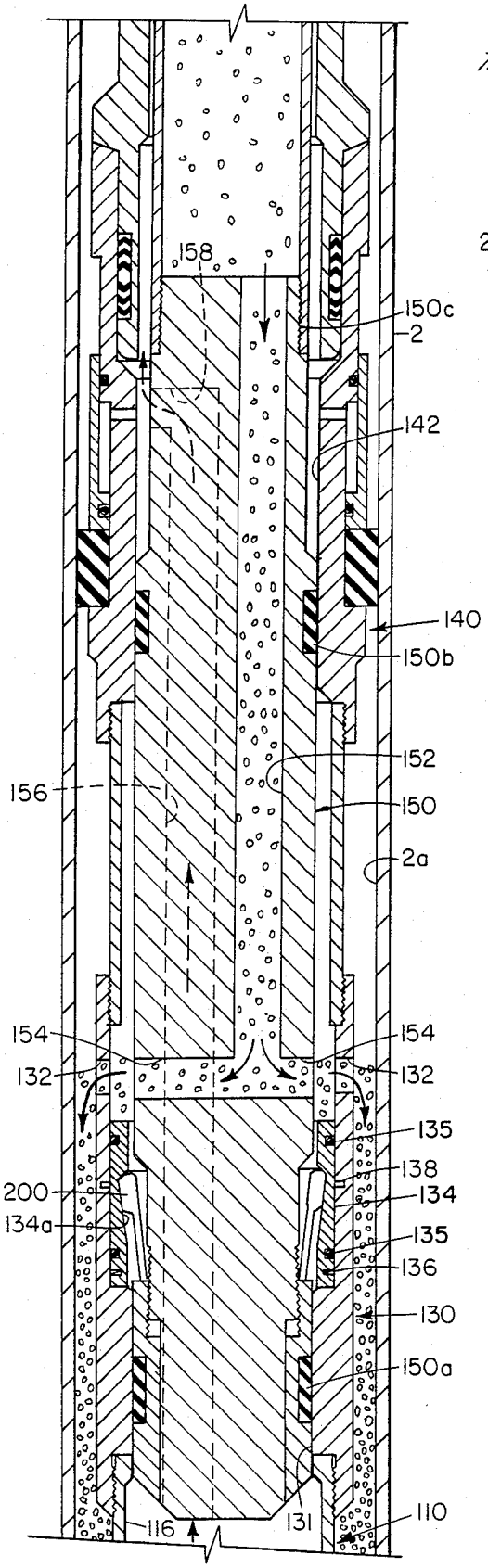
FIGS. 5A, 5B, 5C and 5E collectively represent schematic vertical sectional views of a modified form of a gravel packing system embodying this invention with the packers set, the stabilizer elements expanded into engagement with the well bore, and a cross-over tool inserted in the lowermost isolation packer of the tool string to initiate the gravel packing around the exterior of the lowermost pair of gravel packing apparatuses.
Figure 5A:
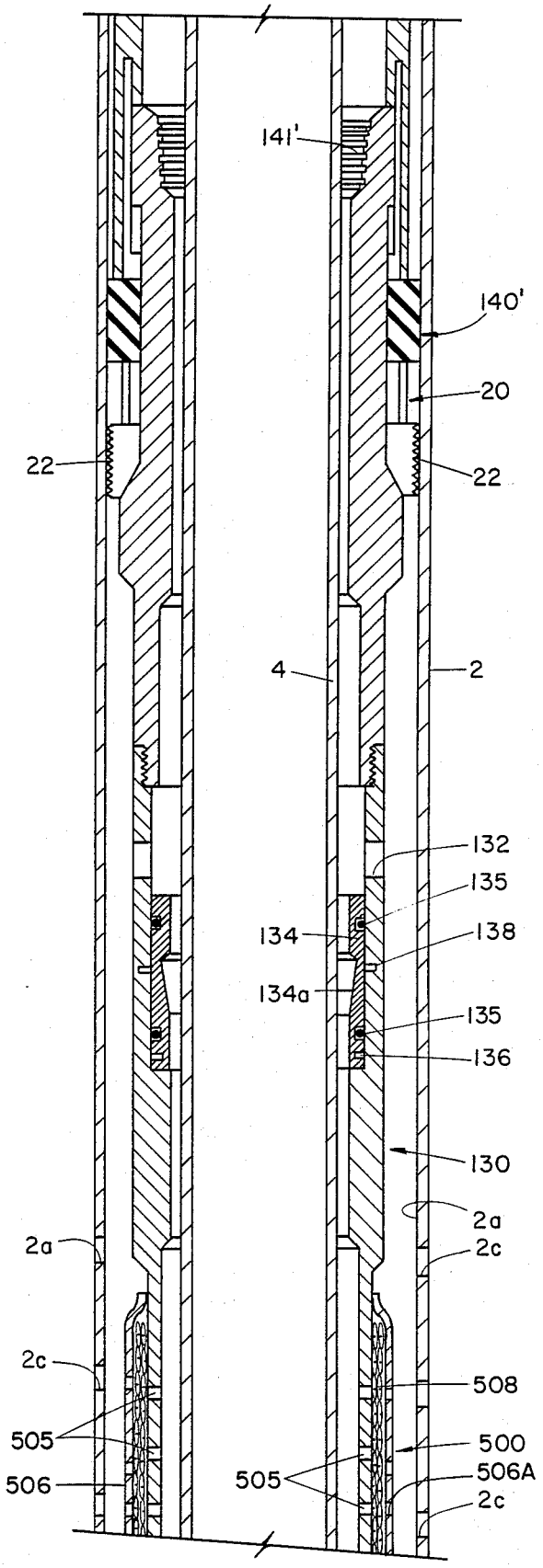
Figure 5B:
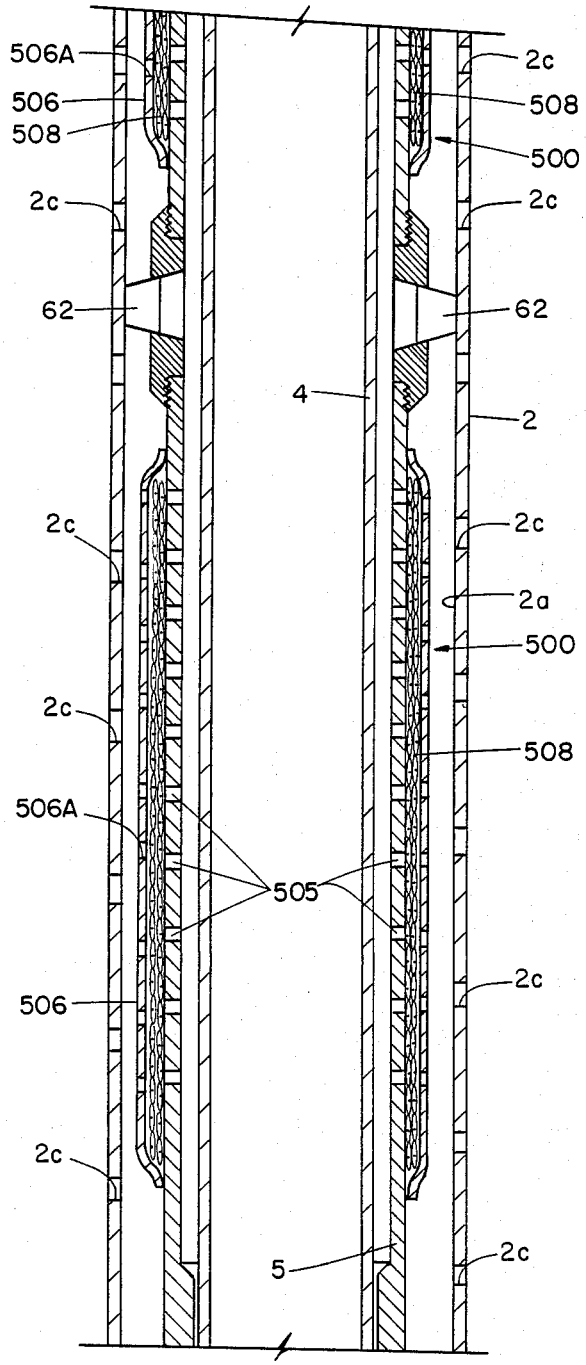
Figure 5D:
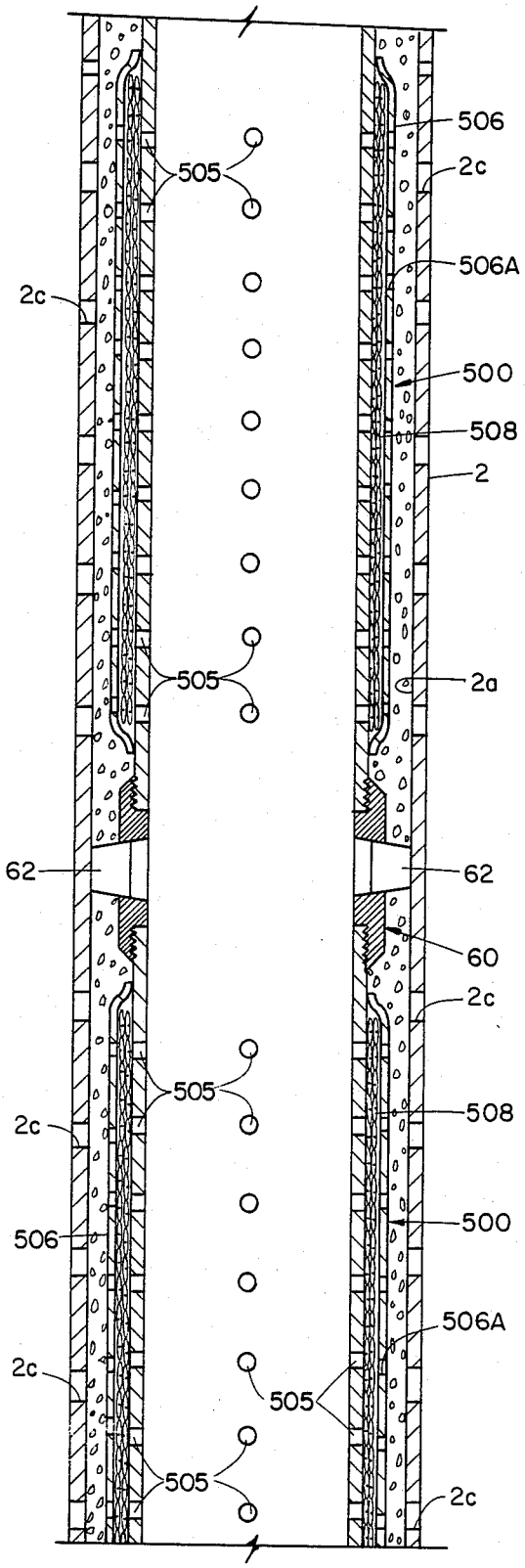
Figure 5E:
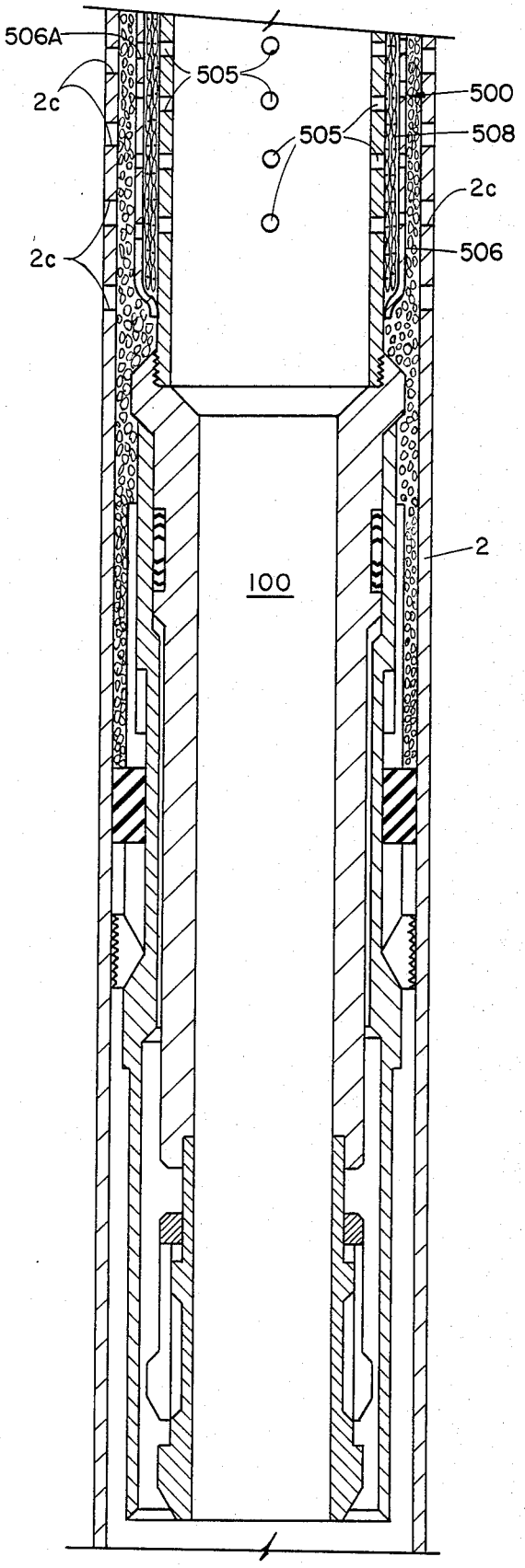

The lowermost end of the screen sections may terminate in a bridge plug (not shown) or a stab-in connection to a sump packer which has previously been set in the bottom end of the casing 2, such as shown in FIG. 5E.

Each stabilizer housing 60 incorporates a plurality of peripherally spaced, radially retracted stabilizer elements 62 which are held in a radially retracted position during run-in of the tool string, as schematically illustrated in FIGS. 2A–2D. The detailed construction of such stabilizers, in two different modifications, will be described in connection with FIGS. 7 and 8.

It should be noted, however, that an annular fluid passage 2*b* is formed by operation of the stabilizers between the inner wall 2*a* of the casing 2 and the exterior of the serially connected screen elements 50, and such annular passage is used to direct the gravel carrying fluid to the exterior of gravel packing apparatuses 500, as will be later described.

The anti-rotation tool 10 performs the function of preventing relative rotation of the work string 3 with respect to the packer 20, thus assuring that the left hand packer threads 20*a* cannot be disengaged during the necessary right hand rotation of the work string required to force the tool string through the short radius curvature portions 1*b* of the well bore 1. Again this represents the preferred and most practical embodiment. If the tool string employs left hand threads, the packer threads 20*a* would be right handed. The detailed construction of the anti-rotation tool 10 will be later described.

As best shown in FIG. 2A, an upper tubular element 41 of a cross-over tool 40 is mounted on external threads 15*c* provided on the inner body sleeve 15 of the rotation preventing tool 10. Tubular element 41 is provided with an annular internal recess 41*a* (FIG. 2B) to receive the head portions 45*c* of a collet type ball seat 45 when such seat is moved downwardly in a manner to be described. Collet seat 45 has a sleeve-like body portion 45*a* secured by shear screws 41*b* to the tubular portion 41 of the cross-over tool 40. Additionally, collet seat element 45 is provided with a plurality of peripherally spaced, upstanding flexible arm portions 45*b* terminating in shown in FIG. 2B, cooperate to form an upwardly facing ball seating surface 45*c* upon which a ball B may be positioned, and also provide a seal with the bore 41*k* of tubular portion 41. The ball B, when dropped or pumped into position, thus seals off the tool string bore extending from the work string 3, and permits internal pressure to be supplied through work string 3 for operation of the fluid pressure operated packer 20 in conventional fashion.

Figure 3A:
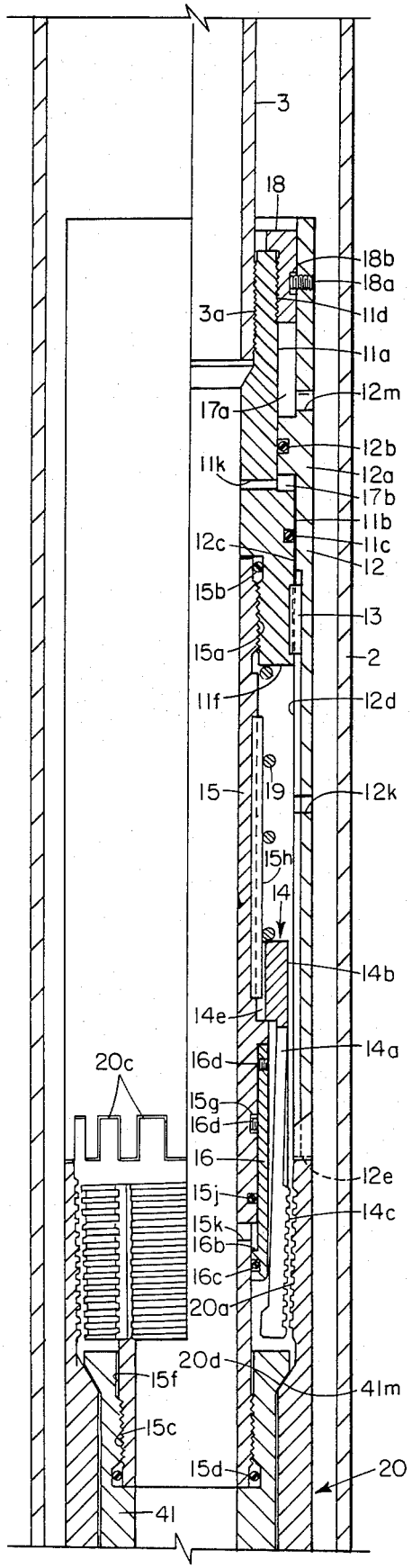
FIGS. 3A, 3B, 3C and 3D are views respectively similar to FIGS. 2A. 2B, 2C and 2D but illustrating setting of the packer the expansion of the stabilizer elements into engagement with the well bore, and the release of the anti-rotation tool.
Figure 3B:
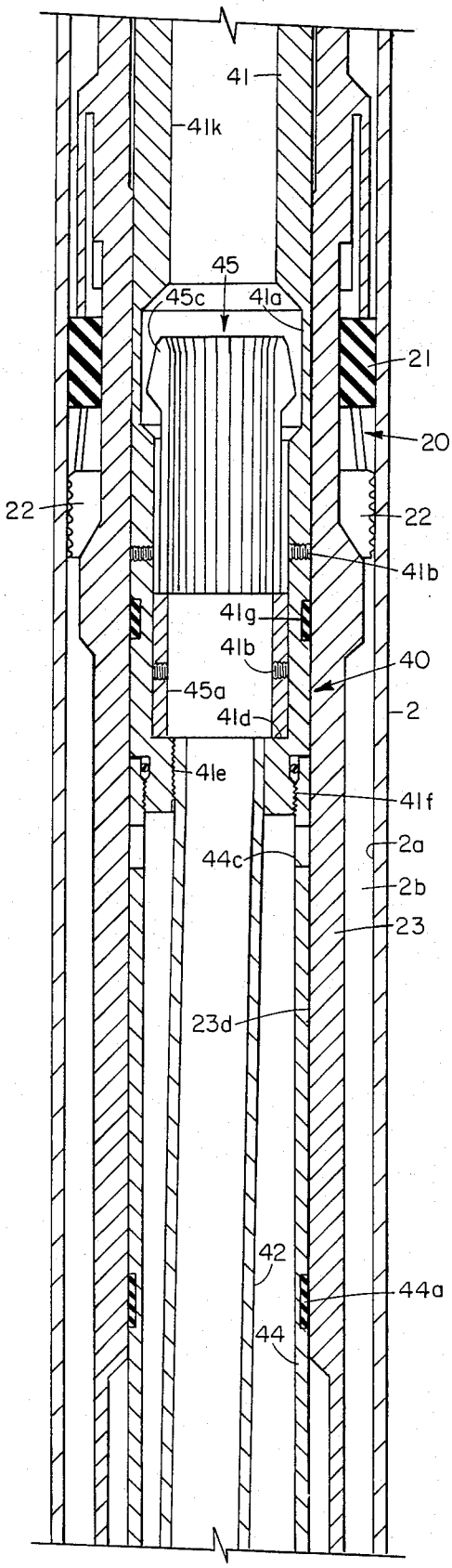
Figure 3C:
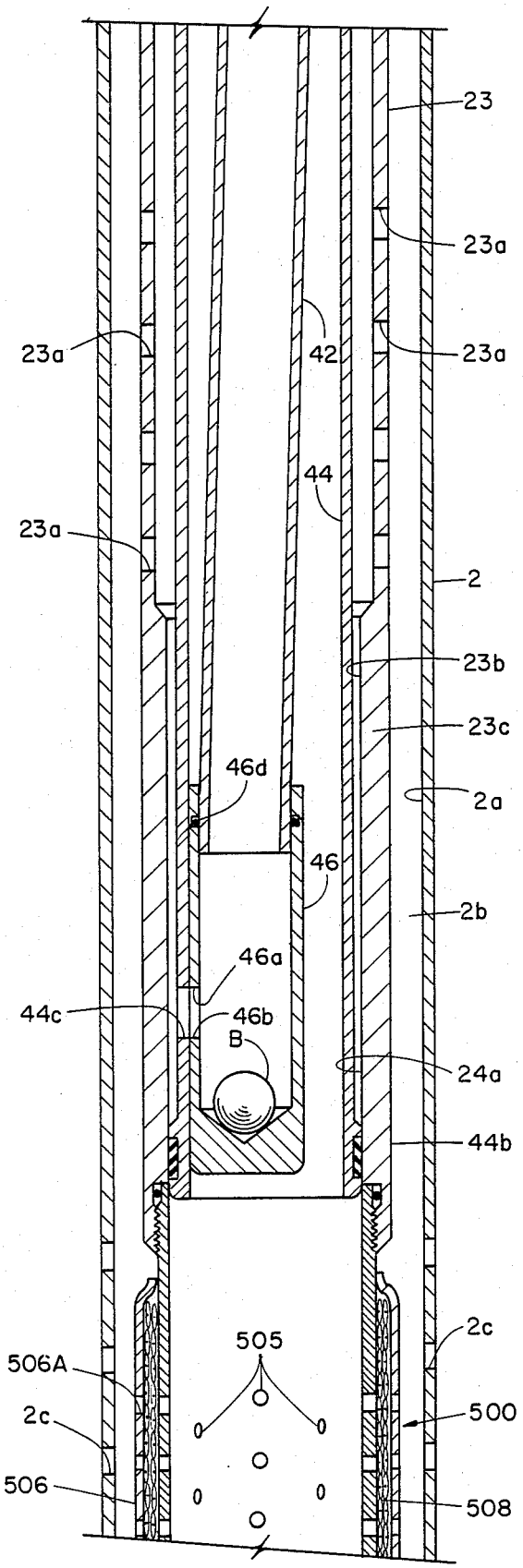
Figure 3D:
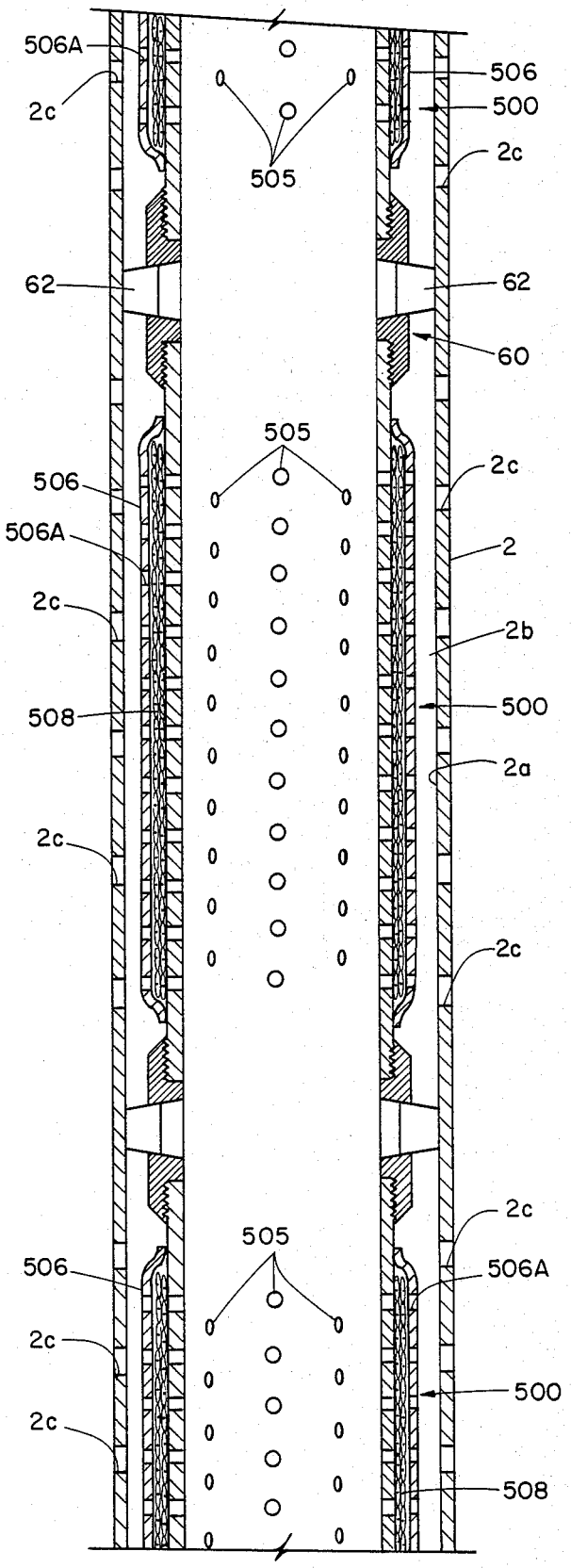

After setting of the packer 20, a further increase in tubing fluid pressure will produce a sufficient downward force on the collet seat 45 to effect the shearing of shear screws 41*b* and force the entire collet seal assembly 45 downwardly, thus permitting the collet arm elements 45*b* to spring outwardly into the recess 41*a* provided in the upper tubular portion of the cross-over tool 41, as is illustrated in FIG. 3B. The ball B is then dropped to the bottom of the cross-over tool, as shown in FIG. 3C, and forms no impairment to the passage of fluid through the bore of the cross-over tool 40.

An external seal 41*g* is provided on tubular element 41 which cooperates with the upper seal bore 20*e* of packer 20. An internally projecting shoulder 41*d* on the bottom end of the upper tubular portion 41 of cross-over tool 40 provides a stop for the downward movement of the collet seat unit 45 and also defines internal threads 41*e* for engagement with the top end of a downwardly extending tube 42 which provides a central fluid passage through the cross-over tool 40. External threads 41*f* provided on the outer surface of shoulder 41*d* effect the securement of a downwardly extending outer tube 44 which defines an annular passage around the central tube 42 for return fluid from the gravel packing operation, in a manner that will be described The outer tube 44 is provided with axially spaced external seals 44*a* and 44*b* which respectively cooperate with the internal surface 23*d* of the downwardly extending sleeve 23 forming part of the body portion of packer 20, and the lower seal bore 23*b*. A plurality of peripherally spaced, radial ports 44*c* are provided around the tope end of the outer tube 44 between external seals 41*g* and 44*a* for a purpose to be hereinafter described.

As best shown in FIG. 2C, the lower end of the inner tube 42 of the cross-over tool 40 is bent sidewise to enter the top end of a cup-shaped securement sleeve 46 which is secured to outer tube 44 by welds 46*b* surrounding a radial port 46*a* provided in the sleeve 46 and communicating with a radial port 44*d* formed in the outer tube 44. O-ring seals 46*d* insure the sealing of the upper end of the cup-shaped sleeve 46 to the lower end of inner tube 42. It will be noted that the radial port 44*d* provided in the outer tube 44 is in fluid communication with the series of axially spaced, radial ports 23*a* provided in the lower portions of the depending tubular extension 23 formed on packer 20. As mentioned, the extreme lower end of outer tube 44 is provided with an external seal 44*b* and, after the packer 20 is set, this seal insures that fluid passing downwardly through the inner tube 42 of cross-over tool 40 and outwardly through the port 44*d* can flow only through the ports 23*a* in the packer body tube 23 and thence into the annulus 2*b* defined between the bore wall 2*a* of the casing 2 and the exterior of the serially connected gravel packing apparatuses 500. The previously mentioned external seals 41*g* and 44*a* on the upper portions of the outer tube 44 also contribute to the isolation of gravel packing or other fluid passed downwardly through the inner tube 44.

Figure 7:
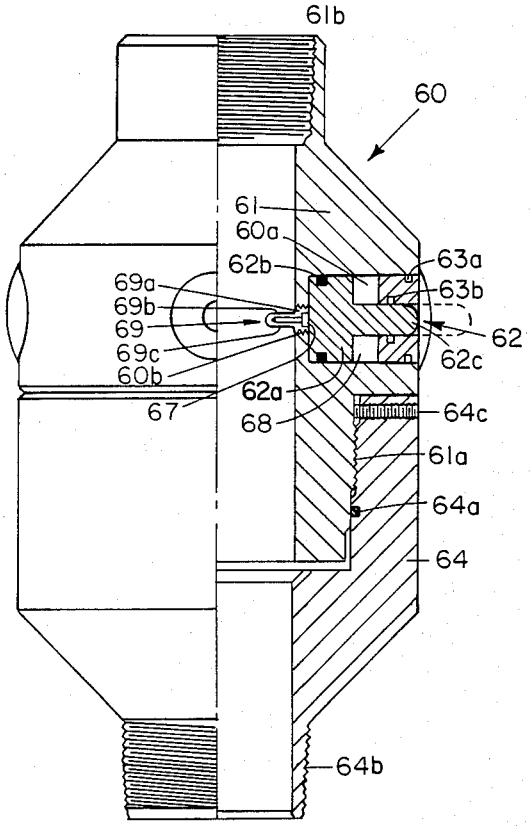
FIG. 7 is an enlarged scale elevational view of a fluid pressure operated stabilizer element employed in cased deviated well bores.

Well hydrostatic pressure is utilized in accordance with this invention, prior to introducing a gravel pack fluid, to effect the expansion of the stabilizer elements 62 from their radially retracted positions in the various stabilizer housings. As best shown in FIG. 7, the stabilizer elements 62 are respectively disposed in a plurality of peripherally spaced, radial bores 60*a* provided in a tubular body element 61. Each stabilizer element 62 comprises a T-shaped piston member having a head portion 62*a* which is disposed in sealing engagement with bore 60*a* by an O-ring 62*b*. The stem portion 62*c* of each stabilizer 62 is of substantially reduced diameter and cooperates in sealing engagement with a bushing 63 which is threadably secured in the bore 60*a*. O-rings 63*a* and 63*b* effect the sealing of the stem portion 62*a* in such bushing.

Plug element 69 comprised of an enlarged threaded head 69*a* and a reduced diameter elongated nose 69*b* threadably and sealingly engages threaded port 60*b* at the inner end of radial bores 60*a*. The nose 69*b* extends into the bore of tubular body element 61 and is tangible by design for a purpose to be later described.

Port 69 extends through the threaded head 69*a* and into the nose 69*b* but does not pass through the entire length of the plug element 69. Thus atmospheric pressure exists in chambers 68 and 67. During insertion into the well bore, only the end of stem portion 62*c* of stabilizer unit 62 is exposed to the well bore fluid so that the stabilizers are biased upwardly by the well bore pressure.

Each stabilizer housing 60 comprising a pair of threadably connected tubular elements 61 and 64 which are interconnected by threads 61*a* and sealed by O-ring 64*a*. Tubular element 61 is provided with box threads 61*b* for connection to the adjoining gravel packing apparatus 500, while tubular element 64 is provided with pin threads 64*b* for connection with an adjoining gravel packing apparatus 500. A set screw 64*c* prevents the accidental separation of the tubular elements 61 and 64.

When it is desired to actuate stabilizer elements 62, tangible nose 69*b* is intentionally broken by conventional means. Said conventional means can include devices inserted into the well by standard oilfield wireline or coiled tubing equipment or an appendage attached to the lower end of cross-over tool 150. Axial movement of such said devices through the internal bore of stabilizer elements 62 will easily break nose 69*b* from head 69*a* thereby exposing chamber 67 to well bore fluid through the open port 69*c*. The piston head 62*a* area is substantially greater than the area of stem portion 62*c*. Thus the introduction of well bore fluid pressure to the head portion 62*a* creates an outward biasing force and displacement of the stabilizer elements 62 moving the stem portions 62*c* into engagement with the bore well 2*a* of the casing 2. Hence, the stabilizer elements 62 may be radially expanded to position the plurality of interconnected screen elements 50 relative to the bore wall 2*a* of the casing 2 traversing the linear non-vertical or horizontal portion 1*c* of the well bore.

Figure 8A:
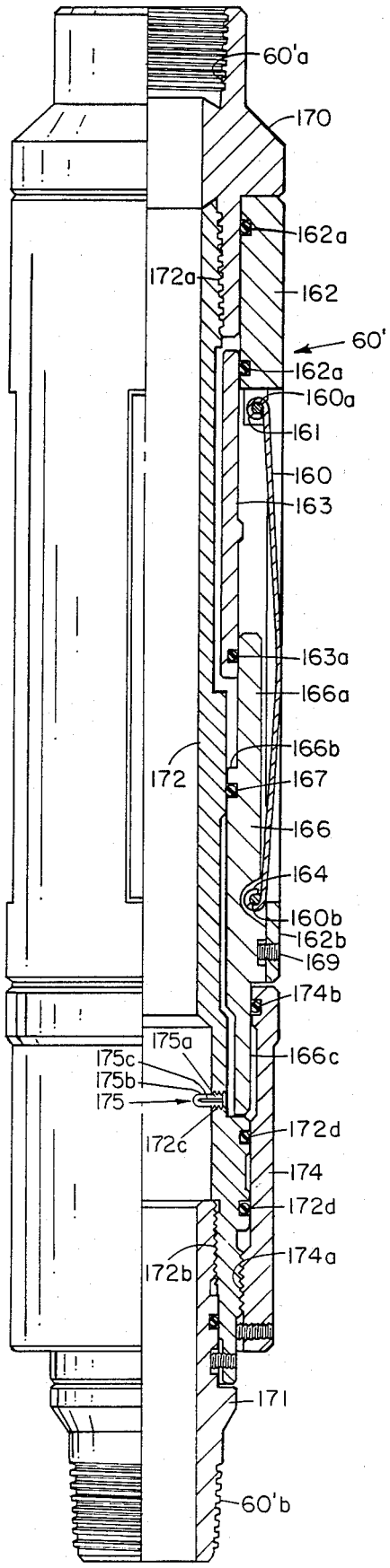
FIG. 8A is an enlarged scale sectional view of a modified fluid pressure operated centralizer element employed in either a cased or uncased deviated well bore shown with the stabilizer elements retracted.
Figure 8B:
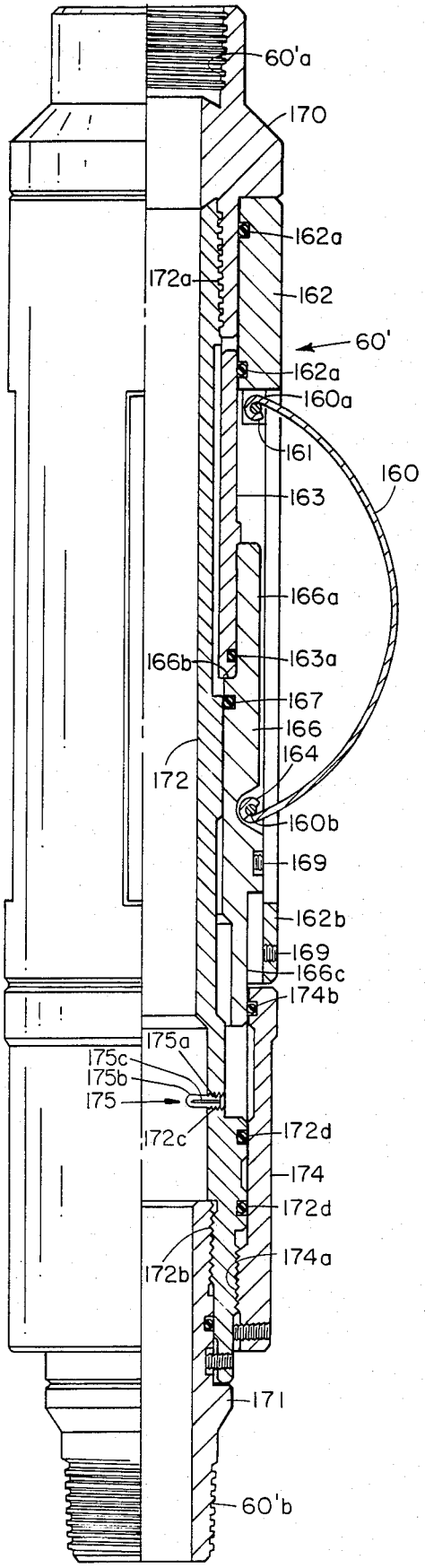
FIG. 8B is a view similar to FIG. 8A but showing the stabilizer elements in their radially expanded positions.

In the event that no casing is inserted in the nonvertical or horizontal portion 1*c* of the well bore 1, then the stabilizer unit 60' shown in detail in FIGS. 8A and 8B may be 60'*a* at one end for connection to the adjacent screen element 50 and pin threads 60'*b* at the other end for connection to an adjacent gravel packing apparatus 500. An upper connecting sub 70 defines box threads 60'*a* while a lower connecting sub 171 defines pin threads 60'*b*. A tubular body element 172 threadably connects the connecting subs by threads 172*a* and 172*b*.

Intermediate the connecting subs 170 and 171, a plurality of peripherally spaced, leaf springs 160 are mounted in flat, radially retracted relationship by having one set of curved ends 161 secured to chordally disposed pins 160*a* mounted in a slotted sleeve 162, which is sealably mounted on upper connecting sub 170 and a stop sleeve 163 by O-rings 162*a*. The other ends of the leaf spring stabilizers 160 have curved ends 164 secured to chordally disposed pins 160*b* which are mounted in a sleeve piston 166. Sleeve piston 166 has a reduced upper end 166*a* directly exposed to well bore pressure, while a smaller diameter inner portion 166*b* of the upper end of piston 166 is exposed to trapped atmospheric pressure by O-ring 167 in piston 166 and O-ring 163*a* in a stop sleeve 163 disposed between piston 166 and body element 172. A cylinder sleeve 174 is secured by threads 174*a* to the lower end of body sleeve 172 and sealed by O-rings 172*d*. Sleeve 174 sealably cooperates by O-ring 174*b* with the external lower surface 166*c* of piston 166. Upward movement of the piston 166 is prevented by a plurality of peripherally spaced shear screws 169 which traverse the lower end 162*b* of the sleeve 162.

Plug element 175 comprised of an enlarged threaded head 175*a* and a reduced diameter elongated nose 175*b* threadably and sealingly engages threaded port 172*c* in body sleeve 172. Port 175*c* extends through the threaded head 175*a* and into the nose 175*b* but does not pass through the entire length of the plug element 175. Thus, the entire lower end of sleeve piston 166 is exposed to trapped atmospheric pressure by virtue of plug element 175 in cooperation with O-rings 172*d*, 174*b* and 167.

During insertion into the well bore, only the upper end 166*a* is exposed to the well bore fluid so that sleeve piston 166 is biased downwardly by the well pore pressure thus retaining stabilizers 160 in a retracted position.

Nose 175b is frangible by design and extends into the bore of body sleeve 172. When it is desired to actuate stabilizer unit 60', nose 175b is intentionally broken by conventional means as previously described thereby exposing the lower end 166c of sleeve piston 166 to well bore pressure.

Since the lower end 166c area is greater than the upper end 166a area, a differential force is exerted on the sleeve piston 166 sufficient to shear the shear screws 169 and cause the piston to move upwardly, as shown in FIG. 8B, thus bowing the stabilizer springs 160 to an outward position to engage the wall of the well bore 1c.

Mention was previously made of the anti-rotation tool 10 which is incorporated in the tool string between the work string 3 and both the packer 20 and the crossover tool 40. As best shown in FIG. 2A, such anti-rotation tool is connected by an externally threaded collet 14 to the packer left hand threads 20a. Thus, any right hand rotation of the work string 3 would produce an unthreading of the collet threads 14c, followed by the upward disconnection of the tubing string 3 from the packer 20. Since very high clockwise torques are required to effect the insertion of the tool string, including the packer 20, through the curved well bore portion 1b, it is necessary to provide a mechanism for preventing rotation of the tool string 3 relative to the packer 20 until the packer is inserted through the curved portion 1b of the well bore 1 and is positioned and set at the desired location in the non-vertical or horizontal portion 1c of the well bore 1.

Such anti-rotation tool comprises a connecting sub 11 secured at its upper end to threads 3a of the tubular work string 3. Connecting sub 11 defines on its upper outer periphery a cylindrical bearing surface 11a. The lower portion of the connecting sub 11 is radially enlarged as indicated at 11b and defines on its outer periphery a cylindrical bearing surface An anti-rotation sleeve 12 is provided in surrounding relationship to the connecting sub 11. Anti-rotating sleeve 12 has an internally projecting shoulder 12a which is engaged in axially slidable relationship with bearing surface 11a of the connecting sub 11 and is sealed thereto by a seal 12b. Anti-rotation sleeve 12 further defines an internal cylindrical surface 12c which cooperates in axially slidable relationship with the external bearing surface 11b provided on the connecting sub 11 and is sealed thereto by seal 11c. Additionally, anti-rotation sleeve 12 is provided with one or more peripherally spaced, axially extending key slots 12d with which keys 13 mounted in appropriate recesses in the enlarged portion 11b of the connecting sub 11 slidably cooperate. Thus, it is assured that the anti-rotation sleeve 12 will be co-rotatable with the work string 3, regardless of its axial position.

The bottom end of the anti-rotation sleeve 12 is provided with a zig-zag configuration extending around its periphery and defining a plurality of peripherally spaced, downwardly projecting square teeth 12e (FIG. 2E) which respectively cooperate and interengage with peripherally spaced, upstanding square teeth 20c formed on the body of the packer 20 above the left hand threads 20a. Thus, so long as the downwardly projecting teeth 12e of the anti-rotation sleeve 12 are in engagement with the upwardly projecting teeth 20c of the packer, the packer is co-rotatably seccured to the work string 3.

To effect the disconnection of the anti-rotation sleeve 12 from the packer 20, such sleeve must be moved upwardly relative to the packer. During run-in, such upward movement is prevented by a plurality of peripherally spaced shear screws 18a which traverse the upper end of the anti-rotation sleeve 12 and engage an annular groove 18b provided in a ring 18 which is threadably secured to external threads 11d provided on the top outer surface of the connecting sub 11.

The actual connection of the anti-rotation tool 10 to the left hand threads 20a of the packer 20 is effected by a plurality of collet arms 14a mounted in peripherally spaced, depending relation on the body portion 14b of a collet 14 and having externally formed thread segments 14c formed on their outer lower ends which engage the packer threads 20a. Collet body 14b is in turn axially slidably mounted on a body sleeve 15 of the anti-rotation tool 10 which is provided with external threads 15a cooperating with internal threads formed on the bottom end of the enlarged portion 11b of the connecting sub 11. Such threads are sealed by an O-ring 15b. The lower end of the body sleeve 15 is provided with external threads 15c for connection to the top end of the upstanding tubular element 41 provided on the crossover tool 40. Such threaded connection is sealed by an O-ring 15d. The upper end of the upstanding tubular portion 41 is provided with a radially enlarged, downwardly facing inclined bearing surface 41m which cooperates with a correspondingly shaped upwardly facing inclined bearing surface 20d formed on the packer body 20.

To secure collet 14 for rotatable axial movement relative to the body sleeve 15 of the anti-rotation tool 10, the ring portion 14b of collet 14 is provided with an axially extending key way 14e which cooperates with a key 15h mounted on the exterior of the body sleeve 15. A spring 19 mounted between the ring portion 14b of collet 14 and the downwardly facing end surface 11f of the connecting sub 11 urges the collet 14 downwardly into its position of engagement with the left hand threads 20a of the packer 20.

The left handed threaded segment teeth 14c on the bottom end of the collet arms 14a are held in engagement with the left handed threads 20a provided on the packer 20 by a piston sleeve 16 which is sealingly engaged with an external cylindrical surface 15e formed on the body sleeve 15 and sealed thereto by an O-ring 15j. The retaining sleeve 16 is further provided with a radially enlarged bottom shoulder 16b which mounts an O-ring 16c for slidably and sealably engaging the reduced diameter lower portion 15f of the body sleeve 15. Collet retaining piston sleeve 16 is secured in its run-in position of holding collet segment threads 14c in engagement with the left hand threads 20a of the packer 20, by one or more shear screws 16d which engage an annular groove 15g formed in the body sleeve 15.

Figure 4A:
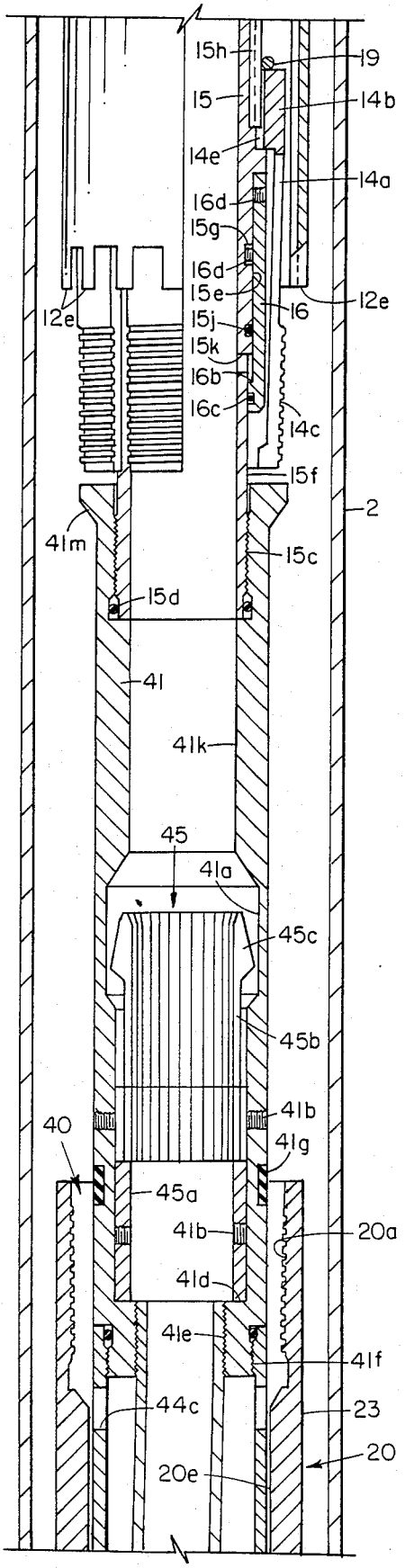
FIGS. 4A, 4B, 4C, and 4D are views respectively similar to FIGS. 3A, 3B, 3C and 3D but illustrating the position of the components during the gravel packing operation.
Figure 4B:
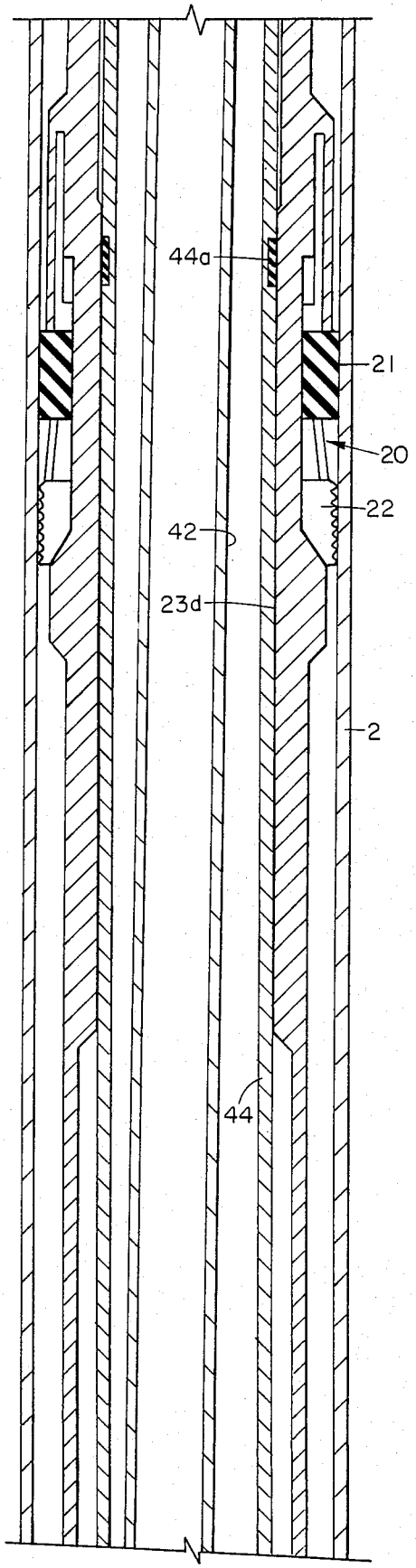
Figure 4C:
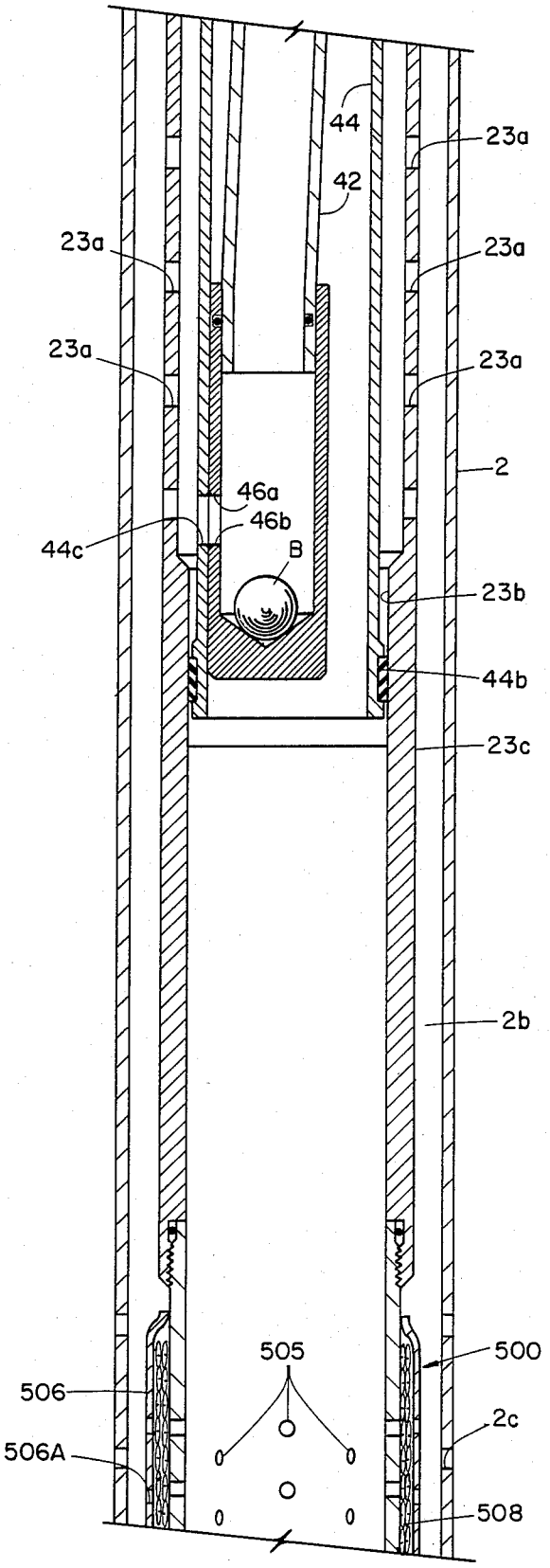
Figure 4D:
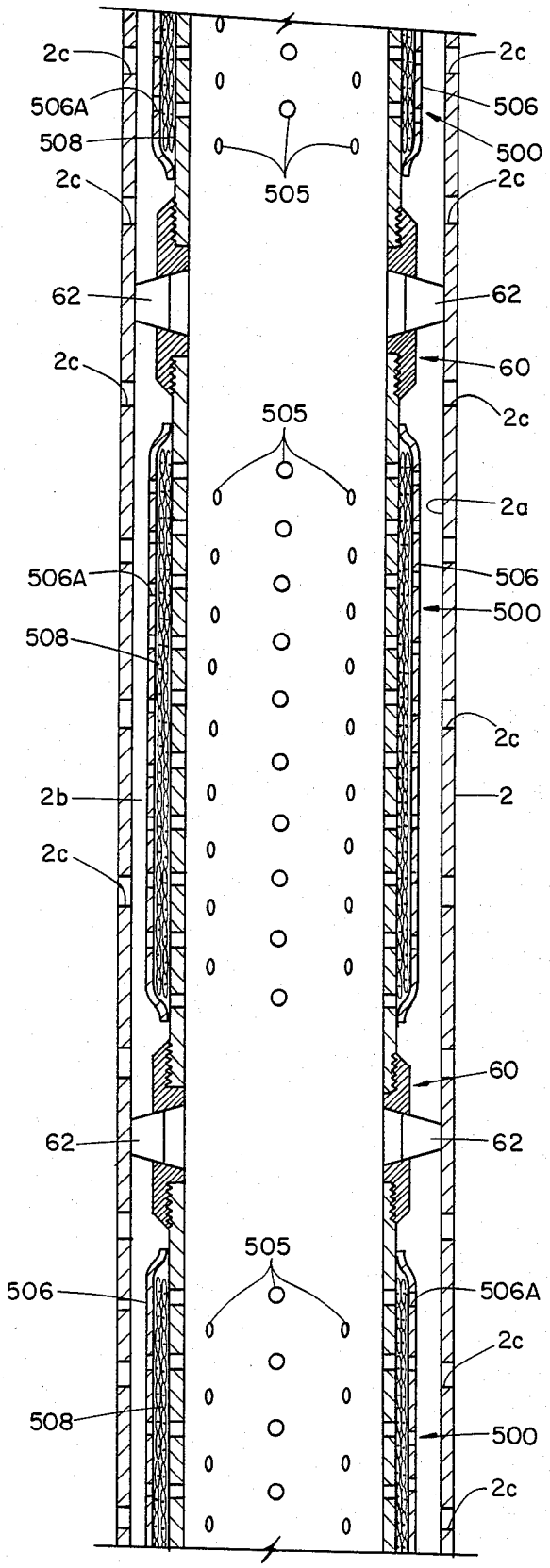

It will thus be observed that the retaining piston sleeve 16 defines an internal chamber 16f which is exposed to the pressure within the tubular work string 3 by the provision of one or more radial ports 15k forced in the body sleeve 15. The external surface of the piston retaining sleeve 16 is exposed to annulus pressure by ports 12k in anti-rotation sleeve 12. Thus, when the annulus pressure is raised to a level above tubing pressure to effect the shearing of shear screws 16d, sleeve piston 16 will move upwardly and the collet 14 will be released from engagement with the left hand threads 20a of the packer 20 (FIG. 3A). The tubing string 3 is then free to move upwardly relative to the packer 20, for a purpose to be hereinafter described (FIG. 4A).

If, for any reason, the collet retaining piston 16 fails to operate, a backup release of the anti-rotation tool 10 is provided at the upper end of the tool. The inwardly enlarged shoulder 12*a* provided on the anti-rotation sleeve 12 cooperates with the bearing surface 11*a* of connecting sub 11 to form two fluid pressure chambers. The upper chamber 17*a* is exposed to annulus pressure through a radial port 12*m* provided in the anti-rotation sleeve 12. The lower chamber 17*b* is connected to tubing pressure through one or more radial ports 11*k* formed in the connecting sub 11. Thus, the application of a fluid pressure within the tubing string 3 in excess of the hydrostatic annulus pressure will exert an upwardly directed force on the shoulder 12*a* of the anti-rotation sleeve 12, shear the shear screws 18*a*, and effect the shifting of the anti-rotation sleeve 12 upwardly a sufficient distance to disengage the interlocking square teeth 12*e* and 20*c*. Such tubing pressure should be greater than that required to set packer 20. Then rotation of the tubular string 3 in a clockwise direction will effect the unthreading of the threaded segments 14*c* provided on the collet 14 from the packer left hand threads 20*a*, the collet 14 moving upwardly along the body sleeve 15 and compressing the spring 18. When the collet segment threads 14*c* are disengaged from the left handed threads 20*a* of the packer 20, the tubing string 3 is then free to be moved upwardly and effect the elevation of the cross-over tool 40.

Thus, two reliable mechanism are provided for effecting the disconnection of the anti-rotation mechanism 10 and permit the work string 3 to move the cross-over tool 40 upwardly as shown in FIGS. 4A–4D, as a necessary step in the accomplishment of the gravel packing operation.

A total of three distinct downhole fluid pressure levels are thus required prior to a gravel packing operation:

(1) A first level of tubing pressure to set packer 20;
(2) An increase in annulus pressure to shift piston sleeve 16 to release the anti-rotation unit 10; and
(3) A second level of tubing pressure (higher than the first level) to open the collet ball seat segments 45*c* and drop ball B.

If, however, the backup release mechanism for the anti-rotation tool 10 is employed, then three levels of tubing pressure are employed:

(1) A first level of tubing pressure to set packer 20;
(2) A second higher level of tubing pressure to deactivate anti-rotation tool 10; and
(3) A third still higher level of tubing fluid pressure to open the collet ball seat segments and drop ball B.

A gravel packing operation may then be conveniently accomplished. Referring to FIGS. 4A–4D, gravel carrying fluid is introduced through the work string 3 and passes downwardly through the bore of the upper tubular element 41 of cross-over tool 40, which has been opened by the downward displacement of the ball B. From this bore, the gravel carrying fluid passes into the inner conduit 42 of the gravel packing element 40 and flows radially outwardly through the ports 46*a* and 44*c* and thence through the packer extension ports 23*a* to enter the annulus 2*b* between the casing bore 2*a* and the exterior of the plurality of serially connected gravel packing apparatus 500 and stabilizer element 60. The gravel will then accumulate around the exterior of the gravel packing apparatus 500. The liquid component of the gravel carrying fluid will pass through the ports 52 and the apertures 53 conventionally provided in such screen elements to enter the fluid flow passageway 505 of the gravel packing apparatus 500 and move upwardly through the annular passage defined between the outer conduit 44 of the cross-over tool 40 and the inner conduit 42. By virtue of the upward movement of the work string 3, accomplished after the release of the work string from the left hand threads 20*a* of the packer 20, the upwardly moving liquid will pass radially out of the ports 44*c* in the upper extremity of the outer conduit 44, and thus pass directly through the packer 20 into the annulus between the casing 2 and work string 3 to flow to the surface of the well.

Following completion of the gravel packing operation, which is indicated at the well surface by a build up in fluid pressure of the gravel carrying fluid, the entire gravel packing element 40, the anti-rotation mechanism 10 and the work string 3 can be retrieved from the well. The well is then ready for production. Production tubing can then be inserted into the well and threadably engaged with the left hand threads 20*a* provided in the packer 20 in conventional fashion.

The foregoing method and apparatus for effecting the gravel packing of a non-vertical or horizontal portion of a well bore is suitable for gravel packing a production zone having a length on the order of 100 to 200 feet or more. When the length of the non-vertical portion 1*c* of the well bore to be gravel packed exceeds approximately 200 feet or more, difficulty may be encountered by the bridging of the gravel around the expanded centralizer elements 62 prior to the entire annulus between the gravel packing apparatuses 500 and the well bore or casing bore being filled with gravel.

Referring now to FIGS. 5A–5E and 6A–6B, a modified apparatus is shown in inserted relationship in that portion of casing 2 traversing the non-vertical or horizontal portion 1*c* of the well bore 1. A gravel packing tool string is assembled for insertion in the well bore 1 by a combined axial and rotational movement. Such tool string comprises a plurality of sections. Each section comprises, from the bottom up, a relatively short length of gravel packing apparatuses 500 which is connected to the bottom of a stabilizer housing 60. The top end of the stabilizer housing 60 is in turn connected to the bottom end of another relatively short length of the gravel packing apparatus 500 and the top end of this screen element is connected to a valve sleeve housing 130. The valve sleeve housing 130 is in turn conventionally connected to the bottom end of an isolation packer 140 which is connected to the bottom end of the next gravel packing section, identical to that previously described.

To facilitate the illustration of the assembled multi-section tool string, the drawings have been limited to the uppermost section and an intermediate section which is also the lowermost section. The uppermost section differs from the intermediate sections only in that the top packer 140' may be of the type having upwardly facing left hand threads 141' to facilitate replacement of a tubular work string with a production string. If rotation of the tool string is required to effect its passage through the deviated well bore, then an anti-rotation device, similar to that previously described, will be required to nonrotationally connect the work string to the uppermost packer 140'.

The bottom end of the lowermost section is stabbed into or otherwise conventionally secured to a conventional sump packer 100 which is set in the casing 2 either prior to insertion of the tubular string or contemporaneously with the insertion of the tubular string in the casing 2.

As illustrated in FIGS. 5A–5E, each of the stabilizer housings 60 contains radially expandable stabilizing elements 62 which are moved outwardly into their position of engagement with the bore wall 2a of the casing 2 through exposure to an increase in the well bore pressure over the hydrostatic pressure existing in the well bore, in the same manner as previously described. This effects the release and expansion of the stabilizer elements 62 in the same manner as has been previously described in connection with FIGS. 7 and 8.

Each valve sleeve housing 130 incorporates a plurality of peripherally spaced, radial ports 132 which can be closed by upward movement of a sleeve valve element 134 having axially spaced O-rings 135 mounted on the exterior thereof. Each sleeve valve unit 134 is provided with an internal recess 134a defining camming surfaces so that a collet carried by the cross-over tool, to be hereinafter described, will slip downwardly past each of the sleeve valves 134, but when moved upwardly, will engage each sleeve valve to move it upwardly to a position wherein the O-rings 135 effect the sealing of the radial ports 132. Alternatively, the sleeve valves 134 may be in a closed position and then be opened by the collet of the cross-over tool.

The isolation packers 140 provided in each of the lower gravel packing sections may be of any conventional type, operated by either axial or rotational movement of the tool string, or may be actuated by an increase in pressure in the well bore above the hydrostatic pressure. All such packers are shown in FIGS. 5A–5E as being in their set positions, from which it will be noted that the successive sets of gravel packing apparatuses 500 effectively isolated from each other, except for fluid connections provided by the radial ports 132.

Referring now to FIG. 5C, there is shown a cross-over tool 150 inserted in the bore of the previously described tool string and positioned adjacent the lowermost gravel packing apparatus. An external seal 150a provided at the lower end of the cross-over tool 150 will be in sealing engagement with a seal bore 131 provided in the valve housing 130 while an axially spaced external seal 150b will be disposed in sealing engagement with the seal bore 142 of the upwardly adjacent packer unit 140. This sealing engagement thus effectively isolates radial ports 132 which are provided in the valve housing 130.

The top end of the cross-over tool 150 is provided with external threads 150c by which it is secured to a tubular work string 4 and is inserted through the casing 2 into the non-vertical portion 1c of the well bore 1 by vertical or horizontal portion 1c of the well bore 1 by combined rotational and axial movements. Cross-over tool 150 is provided with a first axially extending passageway 152 which is open at the top and communicates at its lower end with outwardly directed fluid passageways 154 which, in turn, are disposed opposite the radial ports 132 provided in the sleeve valve housing 130 of the lowermost gravel packing section. In this position, gravel carrying fluid introduced into the well bore through the bore of the work string 4 will pass downwardly through the upper portion of the cross-over tool 150 and then pass radially outwardly through passages 154 into the annulus defined between the tool string and the bore wall 2a of the casing 2. Thus, the gravel carrying fluid will flow around the gravel packing apparatus 500 of the lowermost gravel packing section and the gravel will be trapped by the small openings 509 provided in the screen portion 508 of the gravel packing apparatus 500. The liquid portion will pass through the openings 509 and through a plurality of radial passages 505 to enter the fluid flow passageway 504 of the gravel pack apparatus 500.

From the passageway 504 of the apparatus 500, the liquid component of the gravel carrying fluid passes upwardly through a second axial passage 156 provided in the cross-over tool 150 which has a radial exit port 158 provided adjacent its upper end. Port 158 is located above the external seal 150b. Thus the liquid portion of the gravel carrying fluid can flow upwardly through the annulus surrounding the work string 4 to the well surface, it being recalled that the bore of the tool string above the cross-over tool 150, and the casing annulus are in open communication through the ports 114 provided in the walls of the upper gravel packing apparatuses 500 and the radial ports 132 provided in each of the upper valve housings 130.

Gravel packing of the lowermost gravel packing section is continued until a fluid pressure increase is indicated at the surface which advises the operator that the gravel has been completely packed around the lowermost gravel packing screen elements 110 and reverse the flow of fluid. At this point, the gravel packing operation is interrupted just long enough to move the work string 4 upwardly by a distance sufficient to place the external seals 150a and 150b of the gravel packing tool in straddling relationship to the next upwardly adjacent series of radial ports 132. As the gravel packing tool 150 is moved upwardly, two or more peripherally spaced collet arms 200 conventionally mounted on the periphery of the gravel packing tool engage the contoured notch 134a provided in the sleeve valve 134 and moves such sleeve valve upwardly to a closed position relative to the lowermost series of radial ports 132. The sleeve valve 134 may be retained in such port closing position by the expansion of a C-ring 136 carried on the exterior of the sleeve valve 134 and engagable with an annular notch 138 provided in the body of the sleeve valve housing 130.

Figure 6A:
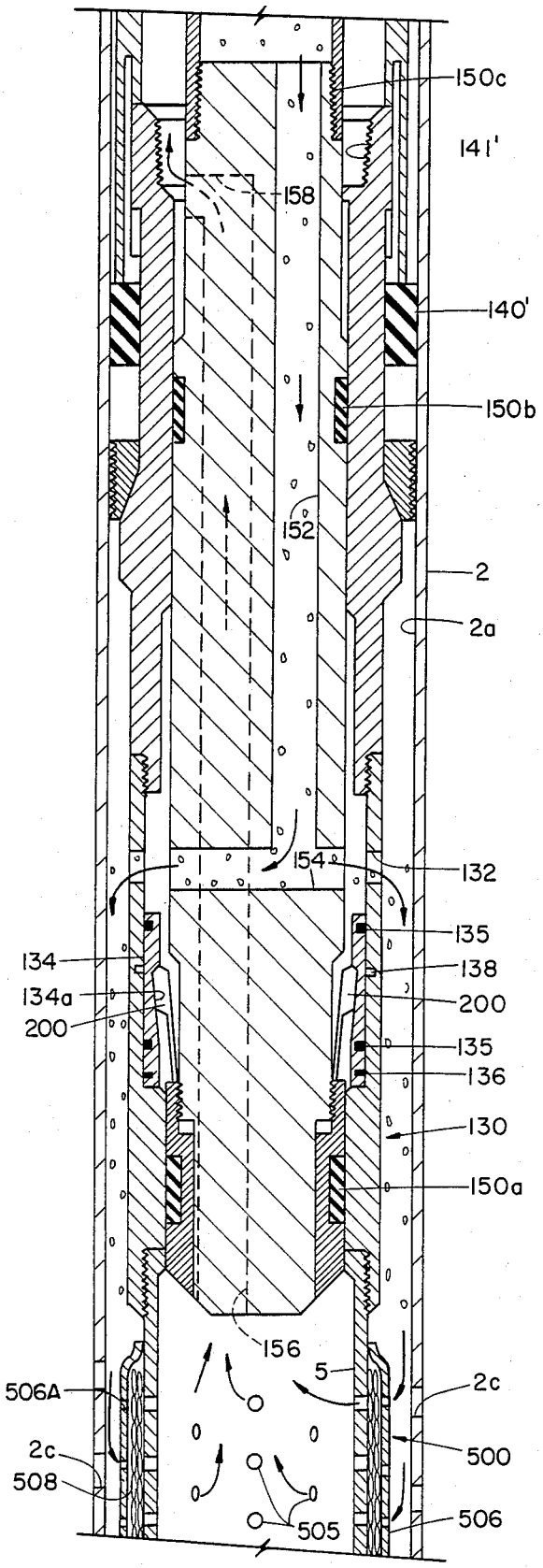
FIGS. 6A and 6B are views respectively similar to FIGS. 5A and 5B, but illustrating the completion of gravel packing around the exterior of the lowermost gravel packing apparatuses and the upward movement of the cross-over tool to initiate the gravel packing around the exterior of the next upwardly adjacent gravel packing apparatus.
Figure 6B:
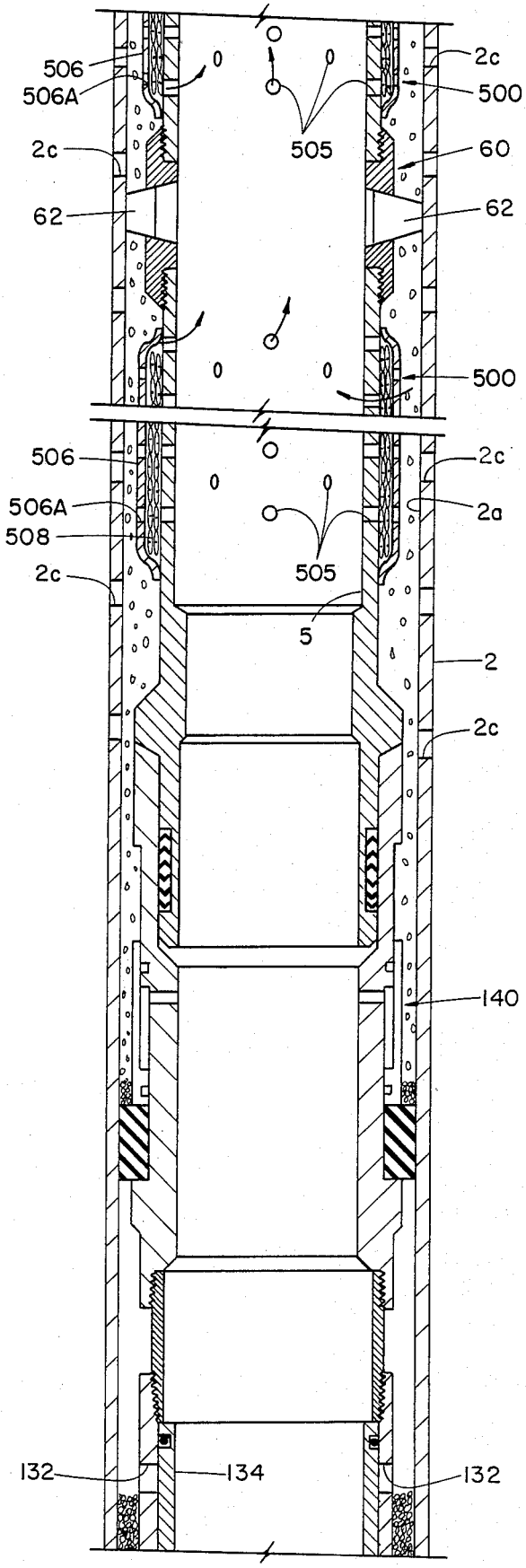

The upward movement of the cross-over tool 150 to the next gravel packing position is schematically illustrated in FIGS. 6A and 6B, and it will be noted that the gravel packing apparatus 500 of the next lowermost section can be packed with gravel around their periphery, while the liquid component of the gravel packing fluid is returned to the surface through the annular passage provided around the work string 4.

Thus, all gravel packing sections may be successively packed with gravel until the entire longitudinal array of the gravel packing string has been packed. Since each tubular screen 110 is of relatively limited longitudinal extent, and the gravel carrying fluid has to pass by a comparatively limited set of expanded stabilizers 62, it is readily apparent that reliable gravel packing of all of the tubular screens involved in a production formation length of 1000 to 2000 feet or more may be readily accomplished.

An advantage of the present invention over prior art pre-pack devices and methods is the ability to reduce the thickness of the pre-pack medium in order to optimize either outer or inner dimensions where tubing thickness is critical in applications such as, for example, completion techniques incorporating gravel packing operations in non-vertical wells. By decreasing the thickness of the pre-pack medium, and thus, the outer and inner dimensions of the device, jet-washing of the screen, when in place in the well, can be enhanced.

In order to test the strength of the apparatus 500 of the present invention for strength against deformation or destruction created by fluid velocity and pressure drop, the apparatus 500 was placed into a test cell into which was pumped over a period of time a fluid, under pressure, to simulate a production fluid from a subterranean well containing particulate matter which is desired to be separated at the apparatus and prior to entry into the production conduit. The wire mesh had openings of 0.0016 per square inch and the wire was of stainless steel with two wrappings, as shown in FIG. 10. The mesh size was 250. The equivalent of 360 barrels per day of fluid was pumped through the test device at 50 psi and a velocity of 68.6 feet per second. The fluid was Houston, Texas water into which was introduced sand having a particle size from between about 80 and about 120 mesh at a concentration of 0.5 pounds per gallon, for a period of 35 minutes. The initial flow rate was approximately 11 gallons per minute at the beginning of the test, and did not vary through the entire test. The results of this test indicated that the apparatus of the present invention is effective in providing a satisfactory "prepacked" gravel packing apparatus for use in subterranean oil and gas wells.

Those skilled in the art will recognize that the aforedescribed method and apparatus provide methods and apparatus for effecting the gravel packing of non-vertical or horizontal portions of a deviated well bore. Despite the fact that the total length of the tubular screen elements may extend over 1000 to 2000 feet, the construction of such length by the threaded assemblage of a plurality of relatively short length screen elements ensures that such screens can be readily passed without damage through the radius curvature portion **1*b* of the well bore 1**.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for use on a subterranean well gravel packing conduit, comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, said wire mesh means having inner and outer wrapping means interwoven between one another, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit.

2. The apparatus of claim 1 wherein said wire mesh means is provided in the form of a weave of inner and outer members thereof.

3. An apparatus for use on a subterranean well gravel packing conduit, comprising:

a cylindrical shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow opening therethrough, said wire mesh being provided in the form of a weave including a series of spaced inner and outer looped metallic weave elements, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit.

4. A method of gravel packing subterranean oil or gas well comprising the steps of:

(1) introducing into said well a subterranean well conduit having disposed thereon at least one well packer apparatus and at least one gravel packing apparatus, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between in the exterior wall of said tubular member and the interior of said particulate-restricting means and passing across said fluid flow passage means, and having fluid flow openings therethrough, said wire mesh means having inner and outer wrapping members interwoven between one another, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

(2) placing said gravel packing apparatus adjacent a production zone in said well;

(3) setting said well packer ; and (4) introducing a carrier fluid containing a particulate matter into said well conduit for placement of said particulate matter exterior of said well conduit and adjacent said production formation.

5. A method of gravel packing a subterranean oil or gas well comprising the steps of:

(1) introducing into the well a conduit having a gravel packing apparatus thereon, said gravel packing apparatus comprising: tubular member a cylindrically shaped inner tubular member having an interior wall an an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, said wire mesh means having inner and outer wrapping members interwoven between one another, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

(2) positioning said conduit in said well such that said gravel packing apparatus is disposed in said well adjacent a hydrocarbon production zone in said well; and (3) flowing fluid through said well and into said gravel packing apparatus and said conduit to the top of the well such that fluid produced from said well and into said conduit does not contain particulate matter of a predeterminable size.

6. A method of completing a well bore having a deviated configuration including an entry portion communicating with a curved portion extending downwardly in the well from said entry portion and a generally linear end portion traversable with a production formation, comprising the steps of:

forming a subterranean well conduit by sequentially securing at least one gravel packing apparatus and a plurality of tubular stabilizer housings, each stabilizer housing containing peripherally spaced, radially shiftable stabilizer elements held in an initial retracted position but shiftable therefrom, said gravel packing apparatus comprising:

a cylindrically shaped inner tubular member having an interior wall and an exterior wall.

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

connecting the formed conduit to a well isolation means;

running the aforementioned conduit into the well bore and manipulating the conduit to facilitate passage of the conduit through the curved portion of the well bore;

setting said well isolation means to position each of said gravel packing apparatuses approximate said linear portion of the well bore; and shifting said radially shiftable stabilizer elements radially outwardly to engage the adjacent wall of the well bore and position said gravel packing apparatuses away from said adjacent wall, whereby production fluids can flow through each of said tubular screen elements to the well surface.

7. The method of claim 6 further comprising the step of gravel packing the well exteriorly around said gravel packing apparatuses.

8. A method of completing a well bore having a deviated configuration including an initial substantially vertical entry portion communicating with a curved portion which in turn communicates with a substantially horizontal portion traversing a production formation, comprising the steps of:

referencing the end of the horizontal well bore to be gravel packed;

forming a tubular subterranean well conduit by sequentially securing at least one gravel packing apparatus and a plurality of tubular stabilizer housings, each stabilizer housing containing peripherally spaced, radially shiftable stabilizer elements held in a radially retracted position by securing means said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

connecting a packer means in said tubular conduit said packer means having setting means associated therewith;

running the aforementioned conduit into the well and manipulating the tubular string to facilitate passage of the conduit through the curved portion of the well bore;

communicating the bottom end of the conduit with the referenced end of the horizontal well to provide an annulus fluid passage external to the conduit and an internal passage within the conduit;

activating the securing means to shift said stabilizer units radially to engage the wall of the well bore and move said screen elements away from said wall; and setting said packer means, whereby production fluid can flow through each of said gravel packing apparatuses to the well surface.

9. A method of completing a well bore having a deviated configuration including an entry portion communicating with a curved portion extending downwardly in the well from said entry portion and communicating with an end portion traversable with a production formation, comprising the steps of:

running an outer conduit within said well bore;

perforating said outer conduit adjacent said production formation;

assembling at the well surface an inner subterranean well conduit dimensioned for concentric positioning within the outer conduit, said inner conduit comprising a plurality of gravel packing apparatuses and a plurality of well isolating means connected in the inner conduit, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing inner conduit, whereby fluid passing through said particulate restricting means and said wire mesh means is filtered to prevent solids of a pre-determinable size from passing into said fluid flow passage means and into said fluid flow passageway through the subterranean well gravel packing inner conduit;

one of said inner and outer conduits carrying tubular stabilizer housings, each stabilizer housing containing stabilizing means movable away from and toward the other of said conduits and being held initially in a position away from the other of said conduits by securing means;

running the inner of said conduits within said outer conduit and manipulating said inner conduit to facilitate passage of the inner conduit through the curved portion of the well bore;

activating said well isolation means to set the well isolation means at a predetermined position within said well; and activating said securing means to shift said stabilizer units radially away from the said one conduit toward the other said conduit to position said gravel packing apparatuses in concentric relation in said end portion of said outer conduit, whereby production fluids can flow through each of said gravel packing apparatuses to the well surface.

10. The method of claim 9 further comprising the step of gravel packing the well exteriorly around said gravel packing apparatuses.

11. The method of completing a deviated subterranean well bore having a non-vertical bore portion traversing a production formation comprising the steps of:

inserting in said non-vertical bore portion at least one gravel packing apparatus interconnected by tubular stabilizer housings, each stabilizer housing mounting a plurality of peripherally spaced, radially shiftable stabilizer elements, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid;

securing said stabilizer elements in a radially , retracted position during run-in; and releasing the securement of said stabilizer elements and shifting said stabilizer elements radially outwardly to engage the well bore when said gravel packing apparatuses are positioned in said production formation.

12. A method of gravel packing a deviated subterranean well bore traversing a production formation at an angle to the vertical and connected to the surface by a curved well bore communicating with a generally vertical bore, comprising the steps of:

assembling at the well surface and successively inserting on a conduit in the vertical bore of the well a plurality of serially connected gravel packing sections;

each section comprising at least one tubular gravel packing apparatus, a valve unit having an opening and a valve member movable between open and closed positions relative to said opening, and an iolator, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

means defining internal seal bores above and below the opening;

running the assembled gravel packing sections into the horizontal well bore on a tubular production conduit;

setting said isolators;

inserting by a tubular work string, a tubular cross-over tool within the bore of the sleeve valve unit of the lowermost gravel packing section, said tubular cross-over tool sealably cooperating with said internal seal bores of said lowermost gravel packing section and defining a fluid passage from the bore of the adjacent packer to the radial port of the sleeve valve unit;

positioning said valve member in said open position relative to said opening;

introducing gravel packing fluid through the tubular work string to flow through said opening into the well annulus surrounding said gravel packing apparatuses of the lowermost gravel packing section;

said tubular cross-over tool defining an axial passage communicating between the bore of the tubular screen elements of the lowermost gravel packing section and the well annulus above the isolator of the lowermost gravel packing section, whereby gravel is packed around the exterior of said lowermost gravel packing apparatuses and the liquid component of the gravel packing fluid is returned to the surface through said axial passage and the well bore annulus;

moving the work string upwardly to shift the cross-over tool upwardly, said cross-over tool being detachably engagable with the valve member of the lowermost gravel packing section to shift the valve member to its said closed position relative to the opening;

positioning the tubular cross-over tool relative to the next gravel packing section to communicate with the bore of the work string with the opening of said next gravel packing section to permit gravel packing of the gravel packing apparatus of the next gravel packing section; and removing the work string and tubular cross-over tool upon completion of gravel packing of all of the gravel packing sections.

13. A method of gravel packing a generally horizontal, subterranean well bore traversing a production formation and connected to the surface by a curved well bore communicating with a generally vertical bore, comprising the steps of:

assembling at the well surface to a subterranean well conduit and successively inserting in the vertical bore of the well, a plurality of serially connected gravel packing sections, the total length of said gravel packing sections approximating the length of the horizontal well bore traversing the production formation;

each gravel packing section including, in upward sequence, a gravel packing apparatus, a tubular valve unit controlling fluid flow from the bore of the unit to the exterior of the unit and a packer having a bore in communication with the bore of said tubular valve unit, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

inserting said serially connected gravel packing sections into said horizontal well bore;

setting said packers; and successively positioning a cross-over tool in the bores of said packers, starting with the lowermost packer, to successively direct gravel carrying fluid supplied from the well surface through each said valve unit to the well bore annulus surrounding said respective gravel packing apparatuses.

14. The method of inserting and positioning a gravel packing tool conduit in a deviated subterranean well bore having a non-vertical bore portion traversing a production formation, said gravel packing tool conduit comprising, from the bottom up, a plurality of gravel packing apparatuses respectively interconnected by tubular stabilizer housings, said stabilizer housings each containing radially expandable stabilizer elements, and a cross-over tool interconnecting the uppermost gravel packing apparatus to a packer having left hand upwardly facing threads, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, at least one of said inner tubular members and said particulate restricting means being secured at at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit;

inserting a tubular rotation preventing tool between the left hand threads and a tubular work string;

inserting the tool string in the well by movement of the tubular work string to advance the entire tool string through the deviated portion of the well to position said gravel packing apparatus within the production formation;

setting said packer in the well bore; and radially expanding said stabilizer elements contained in each stabilizer housing to engage the well bore and centrally position said gravel packing apparatuses in the well bore.

15. A method of gravel packing a subterranean oil or gas well comprising the steps of:

(1) introducing into the well a conduit having a gravel packing apparatus thereon, comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

a fluid-porous particulate-restricting means carried around the exterior wall of said tubular member and having its interior facing the tubular member;

wire mesh means disposed between the exterior wall of said tubular member and the interior of said particulate-restricting means and passing across said fluid flow passage means, and having fluid flow openings therethrough, said wire mesh means having inner and outer wrapping members interwoven between one another, at least one of said inner tubular members and said particulate restricting means being secured at least one of its ends to the subterranean well gravel packing conduit, whereby fluid passing through said particulate restricting means and said wire mesh means is filtered to prevent solids of a pre-determinable size from passing into said fluid flow passage means and into said fluid flow passageway through the subterranean well gravel packing conduit; and (2) positioning said conduit in said well such that said gravel packing apparatus is disposed in said well adjacent a hydrocarbon production zone in said well.

16. An apparatus for use on a subterranean well conduit, comprising:

a cylindrically shaped inner tubular member having an interior wall and an exterior wall;

a fluid flow passageway defined within said interior wall of said tubular member;

fluid flow passage means extending from the interior of said tubular member through the exterior wall of said tubular member and in communication with said fluid flow passageway;

wire mesh means disposed around the exterior wall of said tubular member and passing across said fluid flow passage means, and having fluid flow openings therethrough, said wire mesh means having inner and outer wrapping members interwoven between one another, said inner tubular member being secured at at least one of its ends to the subterranean well gravel packing conduit, whereby fluid passing through said wire mesh means is filtered to prevent solids of a pre-determinable size from passing into said fluid flow passage means and into said fluid flow passageway through the subterranean well gravel packing conduit.

17. A method of gravel packing a subterranean oil or gas well comprising the steps of:

(1) introducing into said well a subterranean well conduit having disposed thereon at least one well packer apparatus and at least one gravel packing apparatus, said gravel packing apparatus comprising: a cylindrically shaped inner tubular member having an interior wall and an exterior wall; a fluid flow passageway defined within the interior wall of said tubular member; fluid flow passage means extending from the interior of said tubular member through the exterior wall of said tubular member and in communication with said fluid flow passageway; wire mesh means disposed around the exterior wall of said tubular member and passing across said fluid flow passage means, and having fluid flow openings therethrough, said wire mesh means having inner and outer wrapping members interwoven between one another, said inner tubular member being secured to at least one of its ends to the subterranean well gravel packing conduit, whereby fluid passing through said wire mesh means is filtered to prevent solids of a pre-determinable size from passing into said fluid flow passage means and into said fluid flow passageway through the subterranean well gravel packing conduit;

(2) placing said gravel packing apparatus adjacent a production zone in said well;
(3) setting said well packer; and
(4) introducing a carrier fluid containing a particulate matter into said well conduit for placement of said particulate matter exterior of said well conduit and adjacent said production formation.

18. A method of gravel packing a subterranean oil or gas well comprising the steps of:
(1) introducing into said well a subterranean well conduit having disposed thereon at least one well packer apparatus and at least one gravel packing apparatus, said gravel packing apparatus comprising: a cylindrically shaped inner tubular member having an interior wall and an exterior wall; a fluid flow passageway defined within the interior wall of said tubular member; fluid flow passage means extending from the interior of said tubular member through the exterior wall of said tubular member and in communication with said fluid flow passageway; wire mesh means disposed around the exterior wall of said tubular member and passing across said fluid flow passage means, and having fluid flow openings therethrough, said wire mesh means having inner and outer wrapping members interwoven between one another, said inner tubular member being secured to at least one of its ends to the subterranean well gravel packing conduit, whereby fluid passing through said wire mesh means is filtered to prevent solids of a pre-determinable size from passing into said fluid flow passage means and into said fluid flow passageway through the subterranean well gravel packing conduit;
(2) placing said gravel packing apparatus adjacent a production zone in said well; and
(3) setting said well packer.

19. A method of completing a well bore having a deviated configuration including an entry portion communicating with a curved portion extending downwardly in the well from said entry portion and a generally linear end portion traversable with a production formation, comprising the steps of:
forming a subterranean well conduit by sequentially securing at least one gravel packing apparatus and a plurality of tubular stabilizer housings, each stabilizer housing containing peripherally spaced, radially shiftable stabilizer elements held in an initial retracted position but shiftable therefrom, said gravel packing apparatus comprising:
a cylindrically shaped inner tubular member having an interior wall and an exterior wall;
a fluid flow passageway defined within the interior wall of said tubular member;
fluid flow passage means extending from the interior of said tubular member through the exterior wall of said tubular member and in communication with said fluid flow passageway;
wire mesh means carried around the exterior wall of said tubular member and passing across said fluid flow passage means, and having fluid flow openings therethrough, said inner tubular member being secured at at least one of its ends to the subterranean well gravel packing conduit, whereby fluid passing through said wire mesh means is filtered to prevent solids of a pre-determinable size from passing into said fluid flow passage means and into said fluid flow passageway through the subterranean well gravel packing conduit;
connecting the formed conduit to a well isolation means;
running the aforementioned conduit into the well bore and manipulating the conduit to facilitate passage of the conduit through the curved portion of the well bore;
setting said well isolation means to position each of said gravel packing apparatuses approximate said linear portion of the well bore; and
shifting said radially shiftable stabilizer elements radially outwardly to engage the adjacent wall of the well bore and position said gravel packing apparatuses away from said adjacent wall, whereby production fluids can flow through each of said tubular screen elements to the well surface.

20. A method of completing a well bore having a deviated configuration including an initial substantially vertical entry portion communicating with a curved portion which in turn communicates with a substantially horizontal portion traversing a production formation, comprising the steps of:
referencing the end of the horizontal well bore to be gravel packed;
forming a tubular subterranean well conduit by sequentially securing at least one gravel packing apparatus and a plurality of tubular stabilizer housings, each stabilizer housing containing peripherally spaced, radially shiftable stabilizer elements held in a radially retracted position by securing means said gravel packing apparatus comprising:
a cylindrically shaped inner tubular member having an interior wall and an exterior wall;
a fluid flow passageway defined within the interior wall of said tubular member;
fluid flow passage means extending from the interior of said tubular member through the exterior wall of said tubular member and in communication with said fluid flow passageway;
outer means carried around the exterior wall of said tubular member and having its interior facing the tubular member;
wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;
connecting a packer means in said tubular conduit said packer means having setting means associated therewith;
running the aforementioned conduit into the well and manipulating the tubular string to facilitate passage of the conduit through the curved portion of the well bore;
communicating the bottom end of the conduit with the referenced end of the horizontal well to provide an annulus fluid passage external to the conduit and an internal passage within the conduit;
activating the securing means to shift said stabilizer units radially to engage the wall of the well bore and move said screen elements away from said wall;

setting said packer means, whereby production fluid can flow through each of said gravel packing apparatuses to the well surface; and introducing a carrier fluid containing a particulate matter into said well conduit for placement of said particulate matter exterior of said well conduit and adjacent said production formation.

21. An apparatus for use on a subterranean well gravel packing conduit, comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, said wire mesh means having inner and outer wrapping members interwoven between one another, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit.

22. A method of gravel packing subterranean oil or gas well comprising the steps of:

(1) introducing into said well a subterranean well conduit having disposed thereon at least one well packer apparatus and at least one gravel packing apparatus, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means ad passing across said fluid flow passage means, and having fluid flow opening therethrough, said wire mesh means having inner and outer wrapping members interwoven between one another, at least one of said inner tubular members and said outer means being secured at at least one of its end to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;

(2) placing said gravel packing apparatus adjacent a production zone in said well;

(3) setting said well packer; and (4) introducing a carrier fluid containing a particulate matter into said well conduit for placement of said particulate matter exterior of said well conduit and adjacent said production formation.

23. A method of gravel packing a subterranean oil or gas well comprising the steps of:

(1) introducing into the well a conduit having a gravel packing apparatus thereon, said gravel packing apparatus comprising:

a cylindrical shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, said wire mesh means having inner and outer wrapping members interwoven between one another, at least one of said inner tubular members and said particulate restricting means being secured at at least one of its ends to the subterranean well gravel packing conduit, whereby fluid passing through said outer means and said wire mesh means is filtered to prevent solids off a pre-determinable size from passing into said fluid flow passage means and into said fluid flow passageway through the subterranean well gravel packing conduit;

(2) positioning said conduit in said well such that said gravel packing apparatus is disposed in said well adjacent a hydrocarbon production zone in said well; and (3) flowing fluid through said well and into said gravel packing apparatus and said conduit to the top of the well such that fluid produced from said well and into said conduit does not contain particulate matter of a pre-determinable size.

24. A method of completing a well bore having a deviated configuration including an entry portion communicating with a curved portion extending downwardly in the well from said entry portion and a generally linear end portion traversable with a production formation, comprising the steps of:

forming a subterranean well conduit by sequentially securing at least one gravel packing apparatus and a plurality of tubular stabilizer housings, each stabilizer housing containing peripherally spaced, radially shiftable stabilizer elements held in an initial retracted position but shiftable therefrom, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, said wire mesh means having inner and outer wrapping members interwoven between one another, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;

connecting the formed conduit to a well isolation means;

running the aforementioned conduit into the well bore and manipulating the conduit to facilitate passage of the conduit through the curved portion of the well bore;

setting said well isolation means to position each of said gravel packing apparatuses approximate said linear portion of the well bore; and shifting said radially shiftable stabilizer elements radially outwardly to engage the adjacent wall of the well bore and position said gravel packing apparatuses away from said adjacent wall, whereby production fluids can flow through each of said tubular screen elements to the well surface.

25. A method of completing a well bore having a deviated configuration including an initial substantially vertical entry portion communicating with a curved portion which in turn communicates with a substantially horizontal portion traversing a production formation, comprising the steps of:

referencing the end of the horizontal well bore to be gravel packed;

forming a tubular subterranean well conduit by sequentially securing at least one gravel packing apparatus and a plurality of tubular stabilizer housings, each stabilizer housing containing peripherally spaced, radially shiftable stabilizer elements held in a radially retracted position by securing means said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;

connecting a packer means in said tubular conduit said packer means having setting means associated therewith;

running the aforementioned conduit into the well and manipulating the tubular string to facilitate passage of the conduit through the curved portion of the well bore;

communicating the bottom end of the conduit with the referenced end of the horizontal well to provide an annulus fluid passage external to the conduit and an internal passage within the conduit;

activating the securing means to shift said stabilizer units radially to engage the wall of the well bore and move said screen elements away from said wall; and setting said packer means, whereby production fluid can flow through each of said gravel packing apparatuses to the well surface.

26. A method of completing a well bore having a deviated configuration including an entry portion communicating with a curved portion extending downwardly in the well from said entry portion and communicating with an end portion traversable with a production formation, comprising the steps of:

running an outer conduit within said well bore;

perforating said outer conduit adjacent said production formation;

assembling at the well surface an inner subterranean well conduit dimensioned for concentric positioning within the outer conduit, said inner conduit comprising a plurality of gravel packing apparatuses and a plurality of well isolating means connected in the inner conduit, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing inner conduit, whereby fluid passing through said outer means and said wire mesh means is filtered to prevent solids of a pre-determinable size from passing into said fluid flow passage means and into said fluid flow passageway through the subterranean well gravel packing inner conduit;

one of said inner and outer conduits carrying tubular stabilizer housings, each stabilizer housing containing stabilizing means movable away from and toward the other of said conduits and being held initially in a position away from the other of said conduits by securing means;

running the inner of said conduits within said outer conduit and manipulating said inner conduit to facilitate passage of the inner conduit through the curved portion of the well bore;

activating said well isolation means to set the well isolation means at a predetermined position within said well; and activating said securing means to shift said stabilizer units radially away from the said one conduit toward the other said conduit to position said gravel packing apparatuses in concentric relation in said end portion of said outer conduit, whereby production fluids can flow through each of said gravel packing apparatuses to the well surface.

27. The method of completing a deviated subterranean well bore having a non-vertical bore portion traversing a production formation comprising the steps of:

inserting in said non-vertical bore portion at least one gravel packing apparatus interconnected by tubular stabilizer housings, each stabilizer housing mounting a plurality of peripherally spaced, radially shiftable stabilizer elements, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid;

securing said stabilizer elements in a radially retracted position during run-in; and releasing the securement of said stabilizer elements and shifting said stabilizer elements radially outwardly to engage the well bore when said gravel packing apparatuses are positioned in said production formation.

28. A method of gravel packing a deviated subterranean well bore traversing a production formation at an angle to the vertical and connected to the surface by a curved well bore communicating with a generally vertical bore, comprising the steps of:

assembling at the well surface and successively inserting on a conduit in the vertical bore of the well a plurality of serially connected gravel packing sections;

each section comprising at least one tubular gravel packing apparatus, a valve unit having an opening and a valve member movable between open and closed positions relative to said opening, and an isolator, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;

means defining internal seal bores above and below the opening;

running the assembled gravel packing sections into the horizontal well bore on a tubular production conduit;

setting said isolators;

inserting by a tubular work string, a tubular cross-over tool within the bore of the sleeve valve unit of the lowermost gravel packing section, said tubular cross-over tool sealably cooperating with said internal seal bores of said lowermost gravel packing section and defining a fluid passage from the bore of the adjacent packer to the radial port of the sleeve valve unit;

positioning said valve member in said open position relative to said opening;

introducing gravel packing fluid through the tubular work string to flow through said opening into the well annulus surrounding said gravel packing apparatuses of the lowermost gravel packing section;

said tubular cross-over tool defining an axial passage communicating between the bore of the tubular screen elements of the lowermost gravel packing section and the well annulus above the isolator of the lowermost gravel packing section, whereby gravel is packed around the exterior of said lowermost gravel packing apparatuses and the liquid component of the gravel packing fluid is returned to the surface through said axial passage and the well bore annulus;

moving the work string upwardly to shift the cross-over tool upwardly, said cross-over tool being detachably engagable with the valve member of the lowermost gravel packing section to shift the valve member to its said closed position relative to the opening;

positioning the tubular cross-over tool relative to the next gravel packing section to communicate with the bore of the work string with the opening of said next gravel packing section to permit gravel packing of the gravel packing apparatus of the next gravel packing section; and removing the work string and tubular cross-over tool upon completion of gravel packing of all of the gravel packing sections.

29. A method of gravel packing a generally horizontal, subterranean well bore traversing a production formation and connected to the surface by a curved well bore communicating with a generally vertical bore, comprising the steps of:

assembling at the well surface to a subterranean well conduit and successively inserting in the vertical bore of the well, a plurality of serially connected gravel packing sections, the total length of said gravel packing sections approximating the length of the horizontal well bore traversing the production formation;

each gravel packing section including, in upward sequence, a gravel packing apparatus, a tubular valve unit controlling fluid flow from the bore of the unit to the exterior of the unit and a packer having a bore in communication with the bore of said tubular valve unit, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;

inserting said serially connected gravel packing sections into said horizontal well bore;

setting said packers; and successively positioning a cross-over tool in the bores of said packers, starting with the lowermost packer, to successively direct gravel carrying fluid supplied from the well surface through each said valve unit to the well bore annulus surrounding said respective gravel packing apparatuses.

30. The method of inserting and positioning a gravel packing tool conduit in a deviated subterranean well bore having a non-vertical bore portion traversing a production formation, said gravel packing tool conduit comprising, from the bottom up, a plurality of gravel packing apparatuses respectively interconnected by tubular stabilizer housings, said stabilizer housings each containing radially expandable stabilizer elements, and a cross-over tool interconnecting the uppermost gravel packing apparatus to a packer having left hand upwardly facing threads, said gravel packing apparatus comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit;

inserting a tubular rotation preventing tool between the left hand threads and a tubular work string;

inserting the tool string in the well by movement of the tubular work string to advance the entire tool string through the deviated portion of the well to position said gravel packing apparatus within the production formation;

setting said packer in the well bore; and radially expanding said stabilizer elements contained in each stabilizer housing to engage the well bore and centrally position said gravel packing apparatuses in the well bore.

31. A method of gravel packing a subterranean oil or gas well comprising the steps of:

(1) introducing into the well a conduit having a gravel packing apparatus thereon, comprising:

a cylindrically shaped inner tubular member having an interior wall and an exterior wall;

a fluid flow passageway defined within the interior wall of said tubular member;

fluid flow passage means extending from the interior of said tubular member through the exterior wall of said tubular member and in communication with said fluid flow passageway;

outer means carried around the exterior wall of said tubular member and having its interior facing the tubular member;

wire mesh means disposed between the exterior wall of said tubular member and the interior of said outer means and passing across said fluid flow passage means, and having fluid flow openings therethrough, said wire mesh means having inner and outer wrapping members interwoven between one another, at least one of said inner tubular members and said outer means being secured at at least one of its ends to the subterranean well gravel packing conduit, whereby fluid passing through said outer means and said wire mesh means is filtered to prevent solids of a pre-determinable size from passing into said fluid flow passage means and into said fluid flow passageway through the subterranean well gravel packing conduit; and (2) positioning said conduit in said well such that said gravel packing apparatus is disposed in said well adjacent a hydrocarbon production zone in said well.

* * * * *